US010003120B2

(12) United States Patent
Kang et al.

(10) Patent No.: US 10,003,120 B2
(45) Date of Patent: Jun. 19, 2018

(54) SMARTPHONE ANTENNA IN FLEXIBLE PCB

(71) Applicant: AQ CORPORATION, Suwon-si, Gyeonggi-do (KR)

(72) Inventors: Young Sung Kang, Yongin-si (KR); Jung Min Kim, Suwon-si (KR); Kyoung Jun Choi, Seoul (KR)

(73) Assignee: AQ CORPORATION, Suwon-si (KR)

( * ) Notice: Subject to any disclaimer, the term of this patent is extended or adjusted under 35 U.S.C. 154(b) by 0 days. days.

(21) Appl. No.: 15/614,484

(22) Filed: Jun. 5, 2017

(65) Prior Publication Data

US 2018/0069294 A1 Mar. 8, 2018

Related U.S. Application Data

(63) Continuation-in-part of application No. 29/587,670, filed on Dec. 14, 2016.

(Continued)

(51) Int. Cl.
*H01Q 7/06* (2006.01)
*H01Q 1/24* (2006.01)

(Continued)

(52) U.S. Cl.
CPC ..... *H01Q 1/242* (2013.01); *H01Q 1/38* (2013.01); *H01Q 7/00* (2013.01)

(58) Field of Classification Search
CPC .... H01Q 1/2208; H01Q 1/2216; H01Q 1/242; H01Q 1/243; H01Q 1/38; H01Q 9/27; H01Q 11/08; H01Q 11/083; H01Q 11/086; G06K 19/0723; G06K 19/0725; G06K 19/025; G06K 19/027; G06K 19/045; G06K 19/145; G06K 19/07773; G06K 19/0095; G06K 19/0029; G06K 19/10099; G06K 19/10108; G06K 19/10138; G06K 19/10188; G06K 19/10237;

(Continued)

(56) References Cited

U.S. PATENT DOCUMENTS 3,017,633 A 1/1962 Marston et al.
5,808,587 A 9/1998 Shima (Continued)

FOREIGN PATENT DOCUMENTS

JP 2003-022912 A 1/2003
JP 2006-195802 A 7/2006

(Continued)

OTHER PUBLICATIONS

Office Action dated Oct. 20, 2017 of co-pending U.S. Appl. No. 15/682,473—29 pages.

*Primary Examiner* — Hoang Nguyen
*Assistant Examiner* — Awat Salih
(74) *Attorney, Agent, or Firm* — Knobbe Martens Olson & Bear LLP

(57) ABSTRACT

A thin, flexible antenna module is provided for use in a smartphone. When the antenna module is assembled in the smartphone, the antenna module provides an MST antenna and an NFC antenna. For this, the antenna module includes a flexible PCB containing two coil antennas and further includes a magnetic sheet engaged with flexible PCB. The flexible PCB and the magnetic sheet are attached to each other to form a single body.

22 Claims, 17 Drawing Sheets

Related U.S. Application Data

(60) Provisional application No. 62/383,332, filed on Sep. 2, 2016.

(51) Int. Cl.
*H01Q 7/00* (2006.01)
*H01Q 1/38* (2006.01)

(58) Field of Classification Search
CPC ..... G06K 19/10297; G06K 19/10386; G06K 19/10445; G06K 19/1097; G06K 19/10247; H04B 5/0081; H04B 5/0062; H04B 5/0056; H04B 5/0093
See application file for complete search history.

(56) References Cited

U.S. PATENT DOCUMENTS

| | | | | |
|---|---|---|---|---|
| 5,929,825 | A | 7/1999 | Niu et al. | |
| 7,000,837 | B2 | 2/2006 | Akiho et al. | |
| 7,712,672 | B2 | 5/2010 | Takahashi et al. | |
| 8,294,629 | B2 | 10/2012 | Yosui et al. | |
| 8,422,190 | B2 * | 4/2013 | Ito | H01F 17/0006 361/119 |
| 8,436,780 | B2 | 5/2013 | Schantz et al. | |
| 8,604,992 | B2 | 12/2013 | Kobayashi et al. | |
| 8,638,268 | B2 | 1/2014 | Yosui et al. | |
| 9,001,001 | B2 | 4/2015 | Nakano et al. | |
| 9,543,655 | B2 | 1/2017 | Lee et al. | |
| 2007/0069961 | A1 | 3/2007 | Akiho et al. | |
| 2009/0189729 | A1 | 7/2009 | Kubo et al. | |
| 2010/0309081 | A1 | 12/2010 | Kobayashi et al. | |
| 2012/0081258 | A1 | 4/2012 | Yosui et al. | |
| 2013/0134225 | A1 | 5/2013 | Teshima | |
| 2014/0049436 | A1 | 2/2014 | Kubo et al. | |
| 2014/0071011 | A1 | 3/2014 | Yosui et al. | |
| 2014/0139380 | A1 | 5/2014 | Ouyang et al. | |
| 2014/0184462 | A1 | 7/2014 | Yosui | |
| 2014/0339915 | A1 | 11/2014 | Kanno et al. | |
| 2015/0077296 | A1 | 3/2015 | An et al. | |
| 2015/0145742 | A1 | 5/2015 | Cao | |
| 2016/0132865 | A1 * | 5/2016 | Park | G06Q 20/3278 705/39 |
| 2016/0149305 | A1 * | 5/2016 | Jeon | H01Q 7/06 343/788 |
| 2016/0254589 | A1 * | 9/2016 | Ju | H01Q 1/2208 343/702 |
| 2016/0336645 | A1 * | 11/2016 | Orihara | H01Q 1/243 |
| 2017/0054213 | A1 | 2/2017 | Singh et al. | |
| 2017/0133744 | A1 * | 5/2017 | An | H01Q 1/2291 |

FOREIGN PATENT DOCUMENTS

| | | | |
|---|---|---|---|
| JP | 2006-270681 | A | 10/2006 |
| JP | 2010-278518 | A | 12/2010 |
| JP | 2012-209619 | A | 10/2012 |
| JP | 2013-013144 | A | 1/2013 |
| JP | 2013-038821 | A | 2/2013 |
| JP | 2013-055637 | A | 3/2013 |
| JP | 2013-121247 | A | 6/2013 |
| JP | 5360202 | B2 | 12/2013 |
| JP | 2014-64284 | A | 4/2014 |
| KR | 10-2003-0076039 | A | 9/2003 |
| KR | 10-2006-0008332 | A | 1/2006 |
| KR | 10-2007-0006702 | A | 1/2007 |
| KR | 10-2008-0008687 | A | 1/2008 |
| KR | 10-2010-0005071 | A | 1/2010 |
| KR | 10-2012-0099131 | A | 9/2012 |
| KR | 10-1185503 | B1 | 9/2012 |
| KR | 10-1282268 | B1 | 7/2013 |
| KR | 10-1339020 | B1 | 12/2013 |
| KR | 10-2015-0051739 | A | 5/2015 |
| WO | 2011/062238 | A1 | 5/2011 |
| WO | 2013/019455 | A1 | 2/2013 |
| WO | 2013/069465 | A1 | 5/2013 |
| WO | 2015/009072 | A1 | 1/2015 |
| WO | WO 2015009072 | * | 1/2015 |
| WO | 2016/056736 | A1 | 4/2016 |

* cited by examiner 300
304
306
WH
302
WB

100

220
200
222
312 (202)
320
322
300

212
214
216
302

220
304
300
200
302
202
222
22
300
28
30
22
G1
28
22
300
28

22
300
28

22
300
28

300
22
28

SMARTPHONE ANTENNA IN FLEXIBLE PCB

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure relates to a smartphone antenna module for use in a smartphone and further relates to a smartphone having the antenna module.

Discussion of Related Technology

Recently, smartphones include a circuit and an antenna for enabling near field RF communication (NFC). Also, some smartphones include other wireless communication circuits and antennas for use in transactions and payments in stores and restaurants with smartphones. For example, a circuit and an antenna for magnetic secure transmission (MST) are applied to some smartphones. However, wireless communication circuits and components for providing various kinds of wireless communications (e.g., LTE communication, Wi-Fi communication and Bluetooth communication) are already housed in smartphones, and various antennas are also mounted in smartphones. In addition, smartphones also have components that may affect the wireless communication, such as a battery and the like. Accordingly, spaces for installing an NFC antenna or MST antenna are limited. This requires additional efforts for designing antennas' structures and layout of components in smartphones.

The foregoing discussion in this section is to provide general background information and does not constitute an admission of prior art.

SUMMARY

An aspect of the invention provides a smartphone antenna module which may comprise:

- a magnetic sheet comprising a first magnetic sheet portion, a second magnetic sheet portion and a third magnetic sheet portion interposed between the first and second magnetic sheet portions;
- a flexible PCB comprising a first coil antenna and a second coil antenna; and
- a through hole formed through the flexible PCB such that the flexible PCB comprises a first PCB section and a second PCB section located on an opposite side of the first PCB section across the through hole,
- wherein, when viewed in a thickness direction of the flexible PCB, the first coil antenna surrounds the through hole, and the second coil antenna surrounds the first coil antenna,
- wherein no electrical connection is formed between the first antenna coil and the second antenna coil within the flexible PCB,
- wherein the flexible PCB and the magnetic sheet are integrated in a single, flexible body, in which the flexible PCB and the magnetic sheet are arranged relative to each other such that:
  - at least part of the third magnetic sheet portion passes the through hole,

- the first magnetic sheet portion is placed over the first PCB section and overlaps a first coil portion of the first coil antenna formed in the first PCB section of the flexible PCB, and
  - the second magnetic sheet portion is placed under the second PCB section and overlaps a second coil portion of the first coil antenna formed in second PCB section of the flexible PCB.

In the foregoing antenna module, the first magnetic sheet portion placed over the first PCB section further may overlap a first coil portion of the second coil antenna that are formed in the first PCB section. The first magnetic sheet portion placed over the first PCB section may extend in a direction away from the second magnetic sheet portion beyond the first coil portion of the second coil antenna. The first magnetic sheet portion placed over the first PCB section may extend in a direction away from the second magnetic sheet portion beyond an edge of the flexible PCB that overlaps with the first PCB section.

Still in the foregoing antenna module, the first coil antenna may comprise a third portion that does not overlap the magnetic sheet at all. The first coil antenna may comprise a fourth portion that does not overlap the magnetic sheet at all, wherein the first, third, second and fourth portions of the first coil antenna are arranged in order surrounding the through hole. The second coil antenna may comprise a third portion and fourth portion that do not overlap the magnetic sheet at all, wherein the first, third, second and fourth portions of the second coil antenna are arranged in order surrounding the through hole.

Yet in the foregoing antenna module, the second magnetic sheet portion placed under the second PCB section further may overlap a second coil portion of the second coil antenna that are formed in the second PCB section. The first magnetic sheet portion placed over the first PCB section may further overlap a first coil portion of the second coil antenna that are formed in the first PCB section. The first magnetic sheet portion may have a first width for passing through the through hole without bending thereof whereas the second magnetic sheet portion has a second width for not passing through the through hole without bending thereof. The through hole may have a maximum linear length of an opening thereof, wherein the first magnetic sheet portion has a first width smaller than the maximum linear length whereas the second magnetic sheet portion has a second width larger than the maximum linear length.

Further in the foregoing antenna module, the through hole may have a maximum linear length of an opening thereof, wherein the first magnetic sheet portion has a first width larger than the maximum linear length whereas the second magnetic sheet portion has a second width larger than the maximum linear length. The through hole may have a maximum linear length of an opening thereof, wherein the first magnetic sheet portion has a first width smaller than the maximum linear length whereas the second magnetic sheet portion has a second width smaller than the maximum linear length.

Still further in the foregoing antenna module, the first coil antenna may comprise a first inner terminal and a first outer terminal, wherein the flexible PCB may further comprises a PCB connector for electrically connecting the first coil antenna to a first counterpart connector of a smartphone, wherein the PCB connector is electrically connected to the first inner terminal and the first outer terminal. The flexible PCB may further comprise a connection line interconnecting the first inner terminal and the PCB connector, wherein the connection line crosses over the first coil antenna and the second coil antenna. The second coil antenna comprises a second inner terminal and a second outer terminal, wherein the PCB connector is also for electrically connecting the second coil antenna to a second counterpart connector of the smartphone, wherein the PCB connector is also electrically connected to the second inner terminal and the second outer terminal. The smartphone antenna module may further comprise a third coil antenna that is not part of the flexible PCB.

Another aspect of the invention provides a smartphone, which may comprise:

a display module comprising a display surface;

the foregoing smartphone antenna module; and a rear wall facing away from the display surface and made of a non-magnetic material, wherein the magnetic sheet is arranged generally parallel to the rear wall.

In the foregoing smartphone, at least part of the first magnetic sheet portion may be interposed between the rear wall and the first PCB section whereas at least part of the second PCB section is interposed between the rear wall and the second magnetic sheet portion. The first coil antenna coil may be connected to a first smartphone circuit for magnetic secure transmission (MST) using a frequency range of 85-100 KHz, wherein the second coil antenna is connected to a second smartphone circuit for near field communication (NFC) using 13.56 MHz. The antenna module may further comprise a third coil antenna that is not part of the flexible PCB.

Still another aspect of the invention provides a smartphone antenna module, which may comprise:

a flexible PCB comprising a first coil antenna and a second coil antenna that are not electrically connected with each other within the flexible PCB;

a through hole formed through the flexible PCB such that the flexible PCB comprises a first PCB section and a second PCB section located on an opposite side of the first PCB section across the through hole, wherein when viewed in a thickness direction of the flexible PCB, the first coil antenna surrounds the through hole and the second coil antenna surrounds the first coil antenna;

a first magnetic sheet placed under or over the first PCB section and overlapping a first coil portion of the first coil antenna that are formed in the first PCB section, the first magnetic sheet comprising a first edge;

a second magnetic sheet placed under or over the second PCB section and overlapping a second coil portion of the first antenna coil that are formed in the second PCB section located on an opposite side of the first PCB section across the through hole, the second magnetic sheet comprising a second edge, wherein the first magnetic sheet and the second magnetic sheet are arranged such that the first edge of the first magnetic sheet overlaps the second magnetic sheet or that the first edge and the second edge are in proximity with each other with a gap therebetween, wherein the flexible PCB, the first magnetic sheet and the second magnetic sheet are integrated in a single, flexible body.

In the foregoing antenna module, the gap may be greater than 0 mm and less than a distance in a range of 0.1 mm to 3 mm.

A further aspect of the invention provides a smartphone, which may comprise:

a display module comprising a display surface;

the foregoing smartphone antenna module; and a rear wall facing away from the display surface and made of a non-magnetic material, wherein the magnetic sheet is arranged generally parallel to the rear wall.

In the foregoing smartphone, the first coil antenna coil is connected to a first smartphone circuit for magnetic secure transmission (MST) using a frequency range of 85-100 KHz, wherein the second coil antenna is connected to a second smartphone circuit for near field communication (NFC) using 13.56 MHz.

DETAILED DESCRIPTION OF EMBODIMENTS

Embodiments of the invention are now described with reference to the accompanying drawings. The terminology used in the description presented herein is not intended to be interpreted in any limited or restrictive manner, simply because it is being utilized in conjunction with a detailed description of certain specific embodiments of the invention.

Various Components in Smartphone

Figure 1:
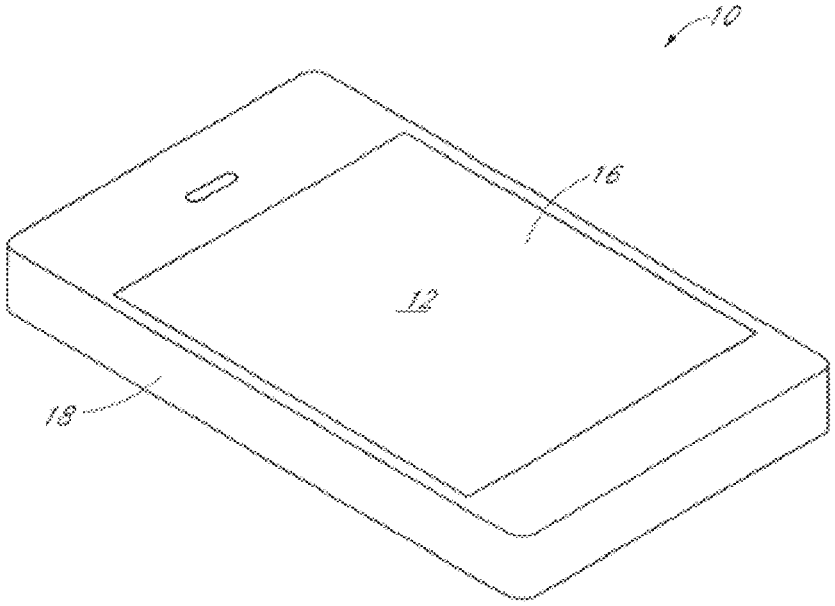
FIG. 1 is a perspective view of a smartphone according to embodiments of the present invention, showing a front side of the smartphone.
Figure 2:
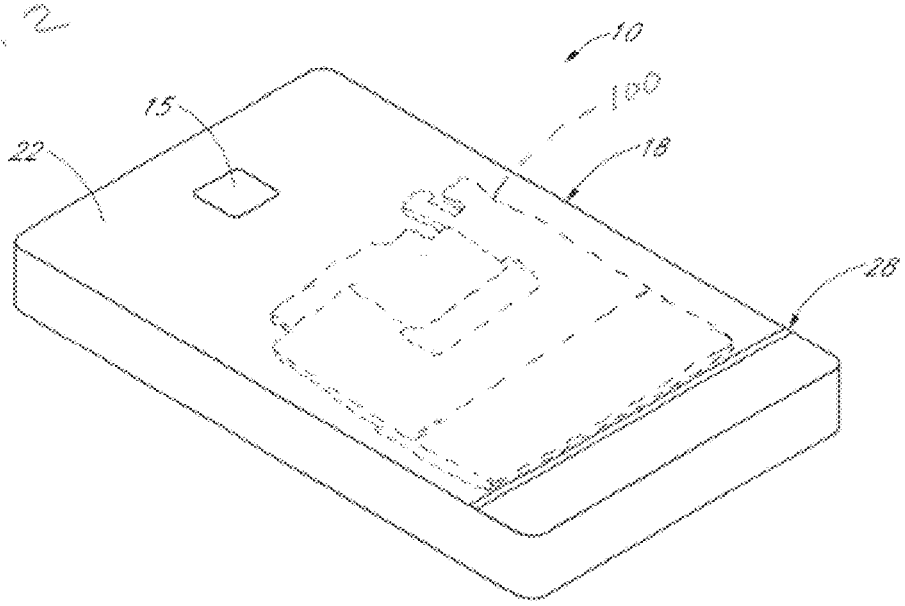
FIG. 2 is a perspective view of the smartphone shown in FIG. 1, showing a backside of the smartphone with an antenna module inside the smartphone according to an embodiment of the invention.
Figure 3:
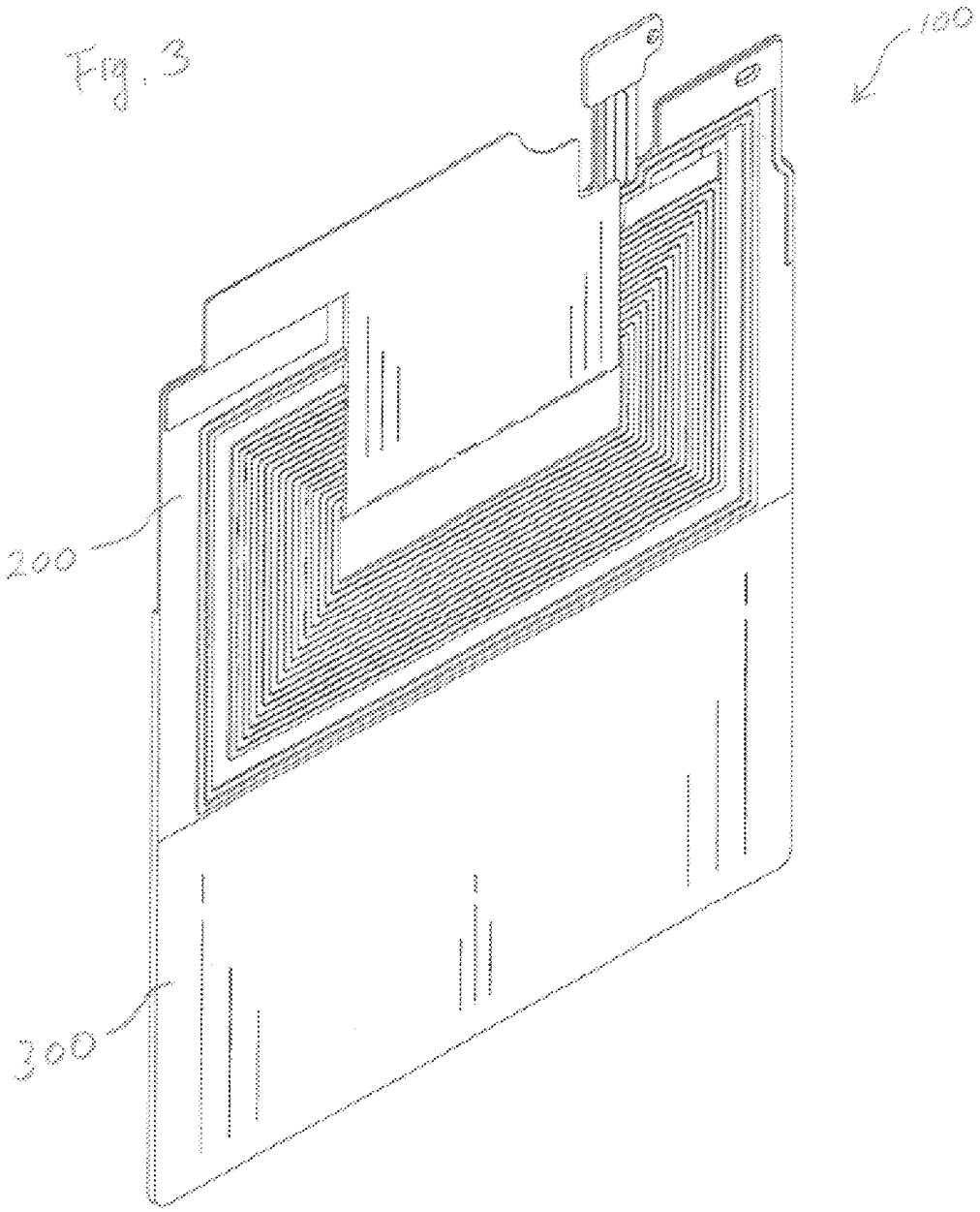
FIG. 3 is a perspective view of the antenna module according to an embodiment of the invention.
Figure 4:
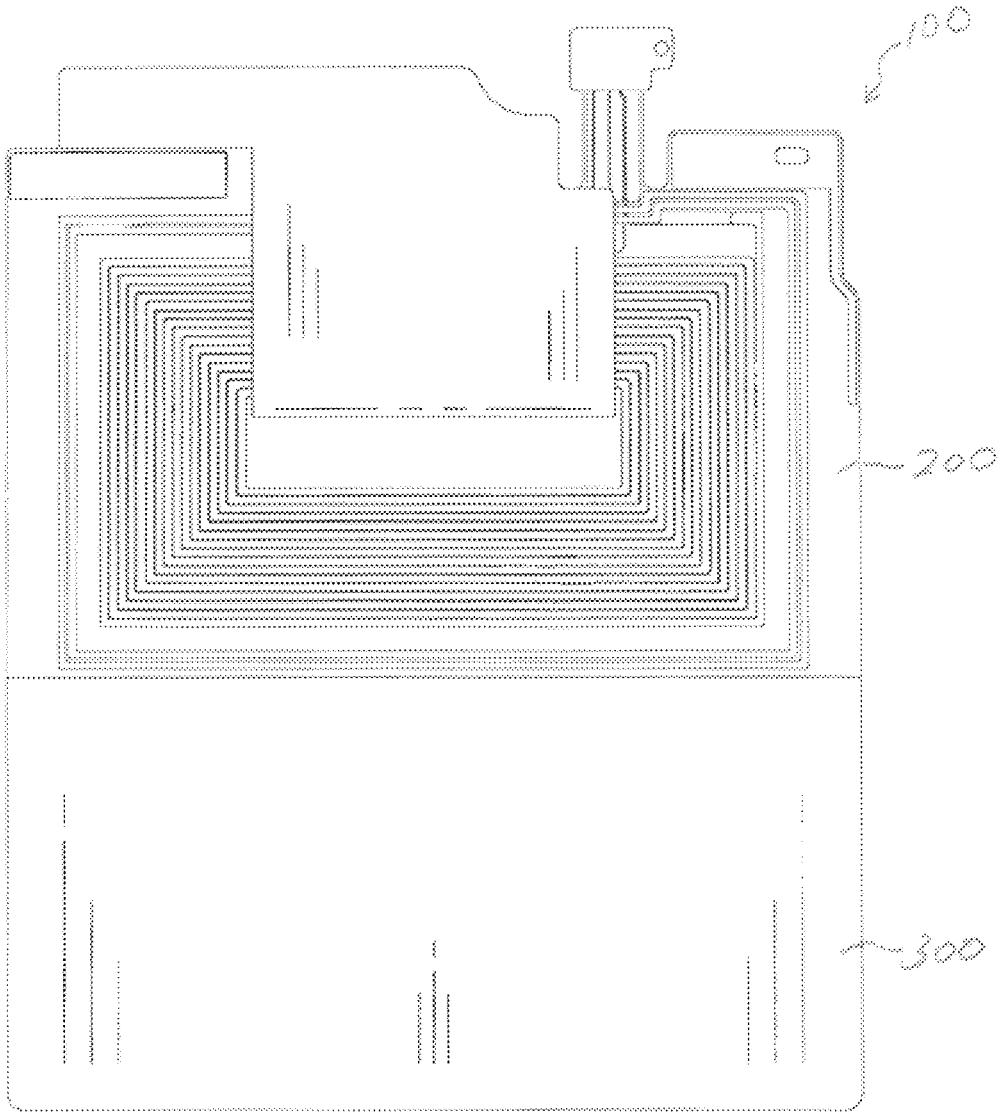
FIG. 4 is a front view of the antenna module shown in FIG. 3.
Figure 5:
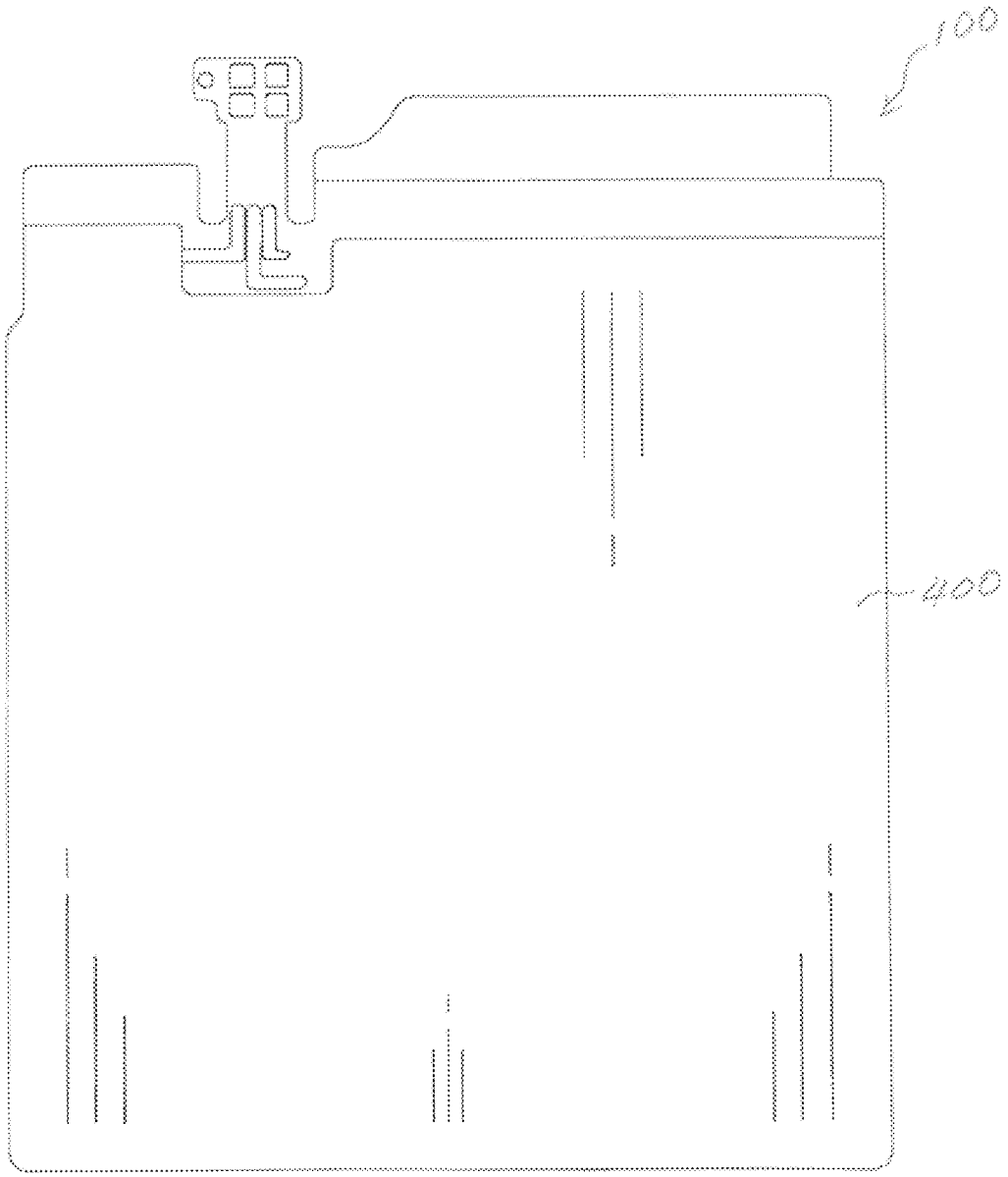
FIG. 5 is a rear view of the antenna module shown in FIG. 3.

In embodiments, referring to FIGS. 1 and 2, a smartphone 10 includes components which include circuits, a display 12, a battery, a camera 15, communication modules and the like. The components are densely integrated in a housing 18 of the smartphone. Recently, for various reasons, the housing of the smartphone tends to be made of a metal. However, the metal housing may significantly affect operations of various antennas in the smartphone. Even in smartphones using non-metallic housing, due to the high degree of compactness, internal components such as a battery may also significantly affect the operations of the antennas.

NFC Antenna and MST Antenna

In embodiments, a smartphone can include an NFC antenna and an MST antenna. The NFC antenna and the MST antenna, among the antennas, use a considerably low frequency band and handle wireless signals of considerably long wavelengths as compared with other wireless antennas, it is typical that the NFC antenna and the MST antenna have sizes greater than those of other antennas. Accordingly, the location of the NFC antenna and the MST antenna overlap with the location of the metal housing, the battery or the like more than those of the other antennas. This requires improvements in the structures of the NFC antenna and the MST antenna and further requires improved layout arranging the NFC antenna and the MST antenna. In embodiments, referring to FIG. 2, a flexible antenna module or apparatus 100 is included in the smartphone.

Flexible Antenna Module

In embodiments, referring to FIGS. 2-5, a flexible antenna module or apparatus 100 is formed in a single, thin, flexible body in which coil antennas for providing an MST antenna and an NFC antenna are integrated. The flexible antenna module includes a flexible PCB 200 with coil antennas 204, 206 for providing the MST antenna and the NFC antenna and further includes a magnetic sheet 300 which is engaged with the flexible PCB 200. The flexible PCB 200 and the magnetic sheet 300 are integrated with each other to form the single, thin, flexible body. In embodiments, additional protective and insulating coatings 400 may be coated over surfaces of the single body (see FIG. 5).

Flexible PCB

In embodiments, referring to FIGS. 3-6, 8, 9, 15, 17, 19 and 20, the flexible PCB 200 has a rectangular sheet shape with a through hole 202 at its center. The flexible PCB 300 includes two coil antennas 204, 206 and coatings coated over the coil antennas to form the sheet shape. Each coil antenna includes a printed wire coil. The two coil antennas include a first coil antenna 204 which functions as an MST antenna and a second coil antenna 206 which functions as an NFC antenna.

First Coil Antenna and Second Coil Antenna

In embodiments, referring to FIGS. 3-6, 8, 9, 15, 17, 19 and 20, the first coil antenna 204 surrounds the through hole 202 and the second coil antenna 206 surrounds the first coil antenna 204. In embodiments, the first coil antenna 204 may include 6, 7, 8, 9, 10, 11 or 12 turns, but the invention is not limited thereto. The second antenna 306 coil may include 2, 3, 4, 5 or 6 turns, but the invention is not limited thereto. In embodiments, the first coil antenna 204 includes turns more than that of the second coil antenna 206.

PCB Connector Portion and Electrical Connection to Terminals of Coil Antennas

In embodiments, referring to FIGS. 3-6, 8, 9, 15, 17, 19 and 20, the flexible PCB 200 includes a PCB connector portion 208 for connecting the coil antennas 204, 206 to a counterpart connection terminal of a smartphone 10. The connector portion 208 is formed at the end portion of an extension 210 located outside the second coil antenna 206. The connector portion 208 includes four connector pads 212 (see FIG. 9). The first coil antenna 204 includes a first inner terminal located in its inner portion and a first outer terminal located in its outer portion. Likewise, the second coil antenna 206 includes a second inner terminal located in its inner portion and a second outer terminal located in its outer portion. Each of the first and second inner terminals and the first and second outer terminals 204 and 206 is connected to one of the four pads 212 via one or more connector lines.

Connector Lines

In embodiments, referring to FIGS. 3-6, 8, 9, 15, 17, 19 and 20, the flexible PCB 200 includes connector lines interconnecting between four pads 212 and the terminals of the coil antennas, respectively. Connector lines include printed conductive lines. For example, a connector line 214 connects the inner terminal of the first coil antenna and one of the pads 212. The connector line 214 extends from the inner portion of the first coil antenna 204 and the outer portion of the second coil antenna 206 (see FIGS. 6 and 9), while crossing lines of the first and second coil antennas 204 and 206 when viewed in a viewing direction along an arrow A shown in FIG. 6 and while extending over the front side of the first coil antenna 204 and the rear side of the second coil antenna 206. Another connector line 216 among the connector lines connects the outer terminal of the first coil antenna 204 and one of the pads 212. In embodiments, the connector line has a width greater than that of a line in the first coil antenna 204 and has a thickness smaller than that of the line in the first coil antenna 204. This configuration can reduce or minimize overall thickness of the antenna module when the coil antenna and the connector line are overlaid. The connector line 216 extends from the inner portion of the second coil antenna 206 and the outer portion of the first coil antenna 204, while crossing lines of the second coil antenna 206 when viewed in the viewing direction and while extending over the rear side of the second coil antenna 206. In the flexible PCB 200, the connector lines are insulated from the coil antennas 204 and 206 that they are crossing via insulation layers.

No Electrical Connection Between First Coil Antenna and Second Coil Antenna

In embodiments, referring to FIGS. 3-6, 8, 9, 15, 17, 19 and 20, there is no electric connection between the first coil antenna 204 and the second coil antenna 206 in the antenna module. Specifically, the first coil antenna 204 and the second coil antenna 206 are spaced apart from each other while the second coil antenna 206 surrounds the first coil antenna 204. Further, each of the connector lines is also spaced from other connector lines. One or more insulation layers are interposed between the first or second coil antenna and the connector lines crossing the first or second coil antenna. Also, each of the four connector pads is apart from other connector pads.

Magnetic Sheet

In embodiments, referring to FIGS. 3-5, 7-9, 16 and 18-20, the magnetic sheet 300 includes a generally rectangular base portion 302 and a head portion 304 extending from an edge 306 of the base portion 302. The head portion is contoured and sized to pass through the through hole 202 and has a width smaller than that of the base portion.

Material of Magnetic Sheet

In embodiments, the magnetic sheet 300 contains magnetic material which is referred to as soft magnet material or ferromagnetic material, for example, ferrite or ferromagnetic metal. In embodiments, the magnetic sheet is entirely made of the magnetic material. In other embodiments, the magnetic material powder or particles are dispersed in a plastic resin matrix of flexible sheet shape.

Assembled State of Flexible PCB and Magnetic Sheet

In embodiments, referring to FIGS. 6-9 and 15-20, the flexible PCB 200 and the magnetic sheet 300 may be assembled as shown in the drawings. When assembled, the head portion 304 of the magnetic sheet 300 passes through the through hole 202. The head portion 304 has a first sheet portion 320 placed over a first PCB portion 220 of the flexible PCB while the base portion 302 has a second sheet portion 322 placed under a second PCB portion 222 of the flexible PCB. The second PCB portion 222 is located on an opposite side of the first PCB portion 220 across the through hole 202.

Coils and Magnetic Sheet

As a result, in embodiments, the first sheet portion 320 overlaps coil portions of the first coil antenna 204 which are located in the first PCB portion 220. Further, the first sheet portion 320 further overlaps coil portions of the second coil antenna 206 which are located in the first PCB portion 220. Similarly, the second sheet portion 322 overlaps coil portions of the first coil antenna 204 which are located in the second PCB portion 222. Further, the second sheet portion 322 further overlaps coil portions of the second coil antenna 206 which are located in the second PCB portion. In other embodiments, the first sheet portion does not overlap the coil portions of the second coil antenna 206 which are located in the first PCB portion 220 while the first sheet portion 320 further overlaps coil portions of the second coil antenna 206 which are located in the first PCB portion 220.

Through Hole and Magnetic Sheet

Figure 8:
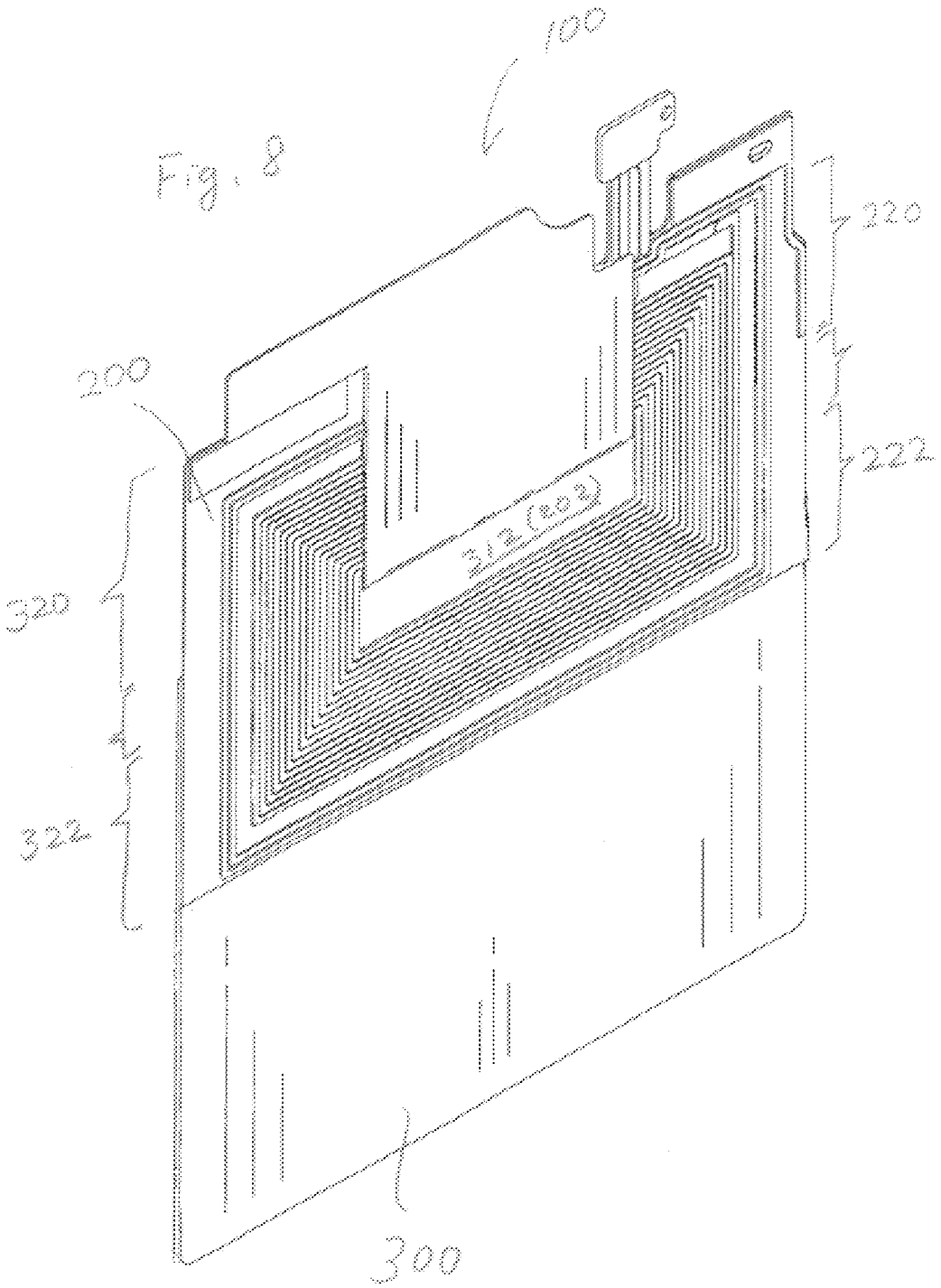
FIG. 8 is a perspective view of an assembly of the flexible PCB shown in FIG. 6 and the magnetic sheet shown in FIG. 7.
Figure 9:
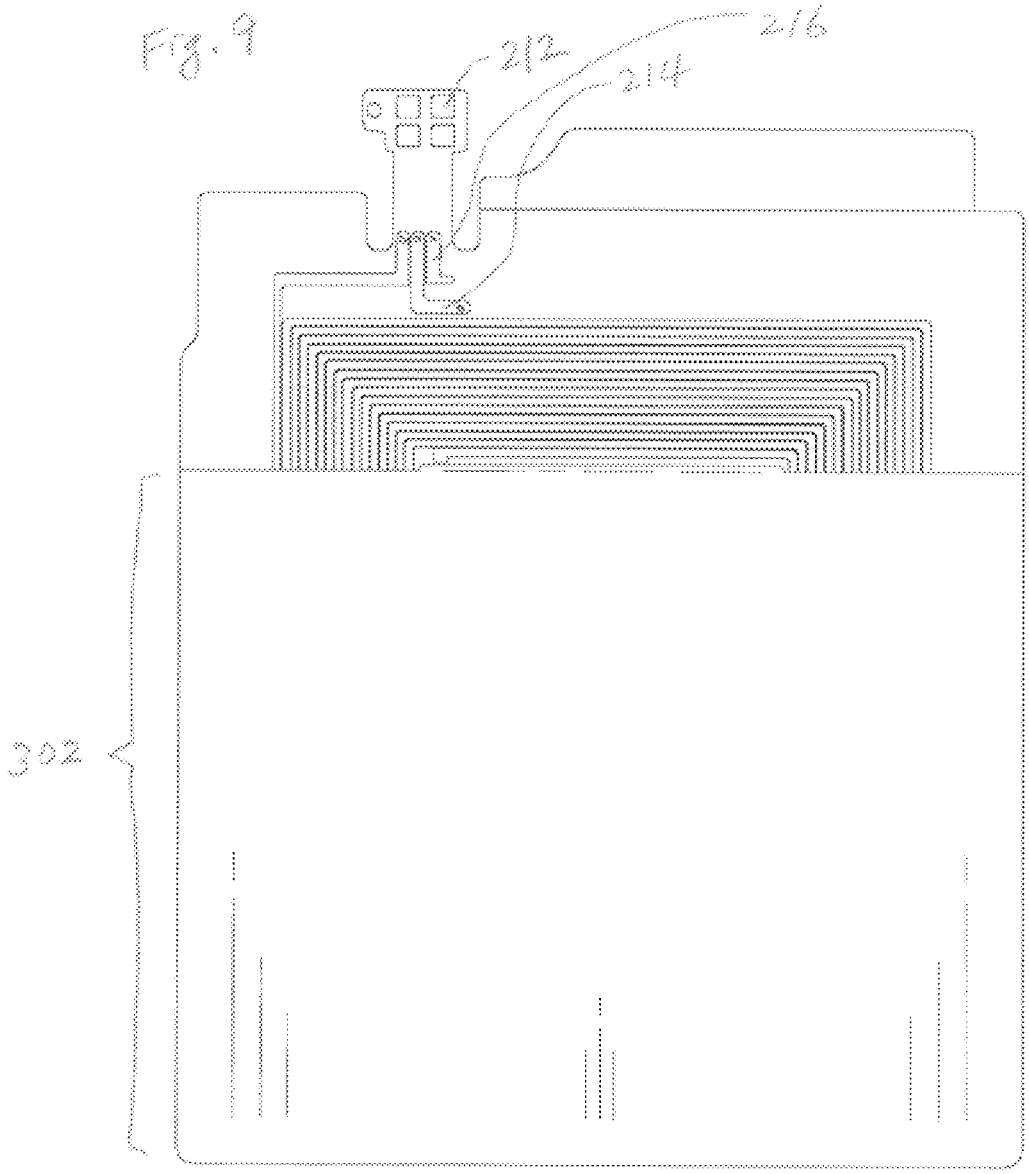
FIG. 9 is a rear view of the assembly shown in FIG. 8.

In embodiments, referring to FIG. 8, the magnetic sheet 300 further includes a third sheet portion 312 overlapping the through hole 202. The third sheet portion 312 interconnects the first sheet portion 320 and the second sheet portion. In one embodiment, the third sheet portion 312 may be a portion of the head portion 304. In another embodiment, the third sheet portion 312 may be a portion of the base portion 302. In other embodiments, the third sheet portion 321 may include both a portion of the head portion 304 and a portion of the base portion 302.

Assembling Flexible PCB and Magnetic Sheet

In embodiments, referring to FIGS. 6-9 and 15-20, when assembling, the head portion 304 is inserted through the through hole 202 and passes the through hole 202 until the edge 306 contacts the flexible PCB. Then, the base portion 302 is attached to the second PCB portion 222 by using, for example, an adhesive. In other embodiments, the head portion 304 is attached to the first PCB portion 220.

Sizes of Portions of Flexible PCB and the Portions of Magnetic Sheet

Figure 6:
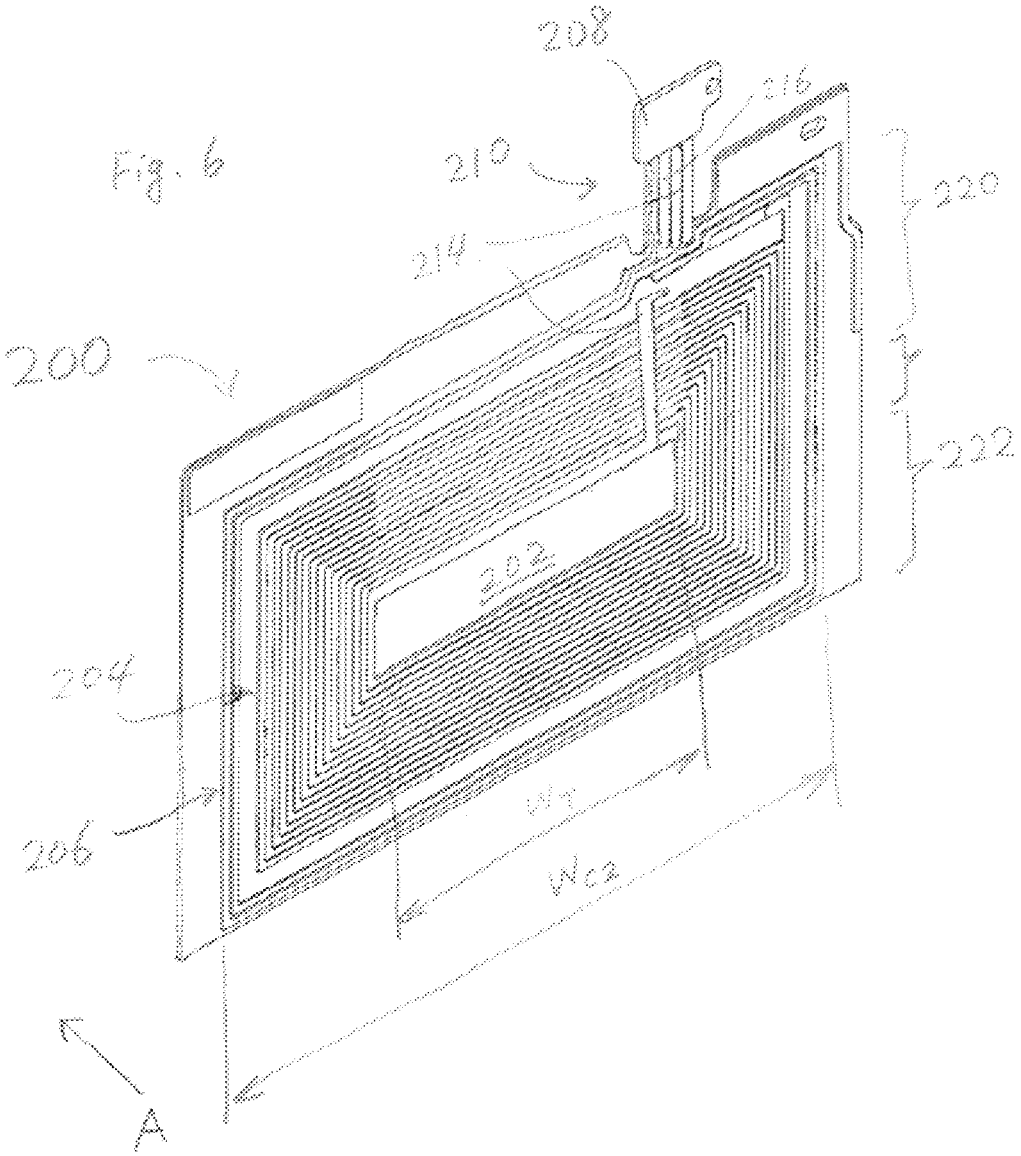
FIG. 6 is a perspective view of a flexible PCB according to an embodiment of the invention.
Figure 7:
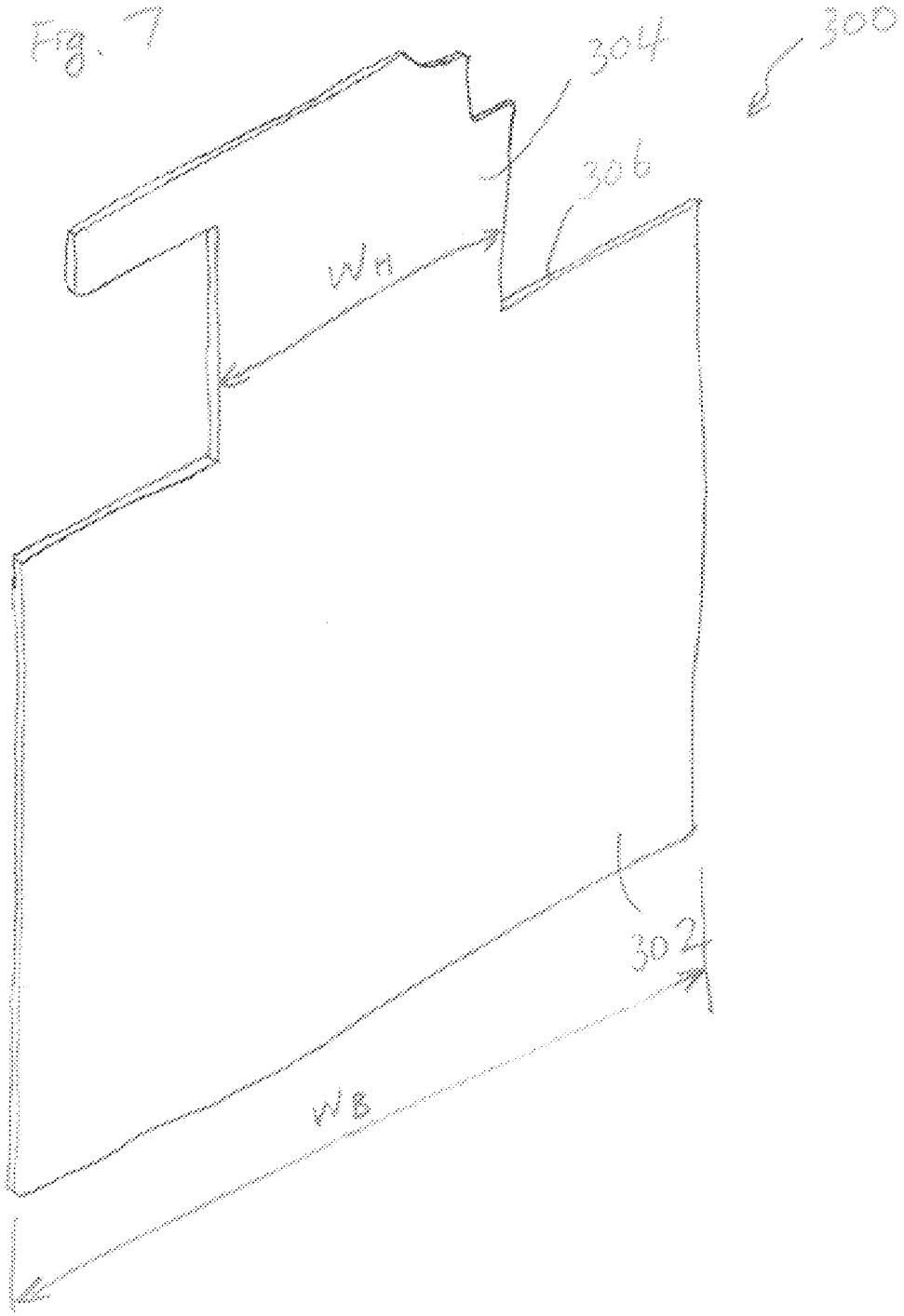
FIG. 7 is a perspective view of a magnetic sheet according to an embodiment of the invention.

In embodiments, referring to FIGS. 6, 7 and 8, the head portion 304 (the first sheet portion 320) has a width $W_H$ smaller than that $W_T$ of the through hole 202 such that the head portion 304 passes through the through hole without bending the magnetic sheet 300. Further, the base portion 302 (the second sheet portion 322) has a width $W_B$ greater than that $W_T$ of the through hole 202 such that the head portion 304 cannot pass through the through hole without bending the magnetic sheet 300. Additionally, the base portion 302 (the second sheet portion 322) has a width $W_B$ greater than that $W_{C2}$ of the second coil antenna 206. However, the invention is not limited thereto. In another embodiment, the base portion 302 (the second sheet portion 322) has a width $W_B$ smaller than that $W_T$ of the through hole 202. In a further embodiment, the head portion 304 (the first sheet portion 320) has a width $W_H$ greater than that $W_T$ of the through hole 202 such that the head portion 304 passes through the through hole with bending the magnetic sheet 300. In other embodiments, the head portion 304 (the first sheet portion 320) has a width $W_H$ substantially the same with that $W_B$ of the base portion 302 (the second sheet portion 322).

Other Embodiments of Magnetic Sheet

In embodiments, the head portion has a width greater than that of the through hole. In this configuration, the head portion is bent when passing through the through hole. The magnetic sheet further includes a neck portion between the base portion and the head portion. The neck portion has a width smaller than that of the through hole.

Two or More Separate Magnetic Sheet Pieces

Figure 24:
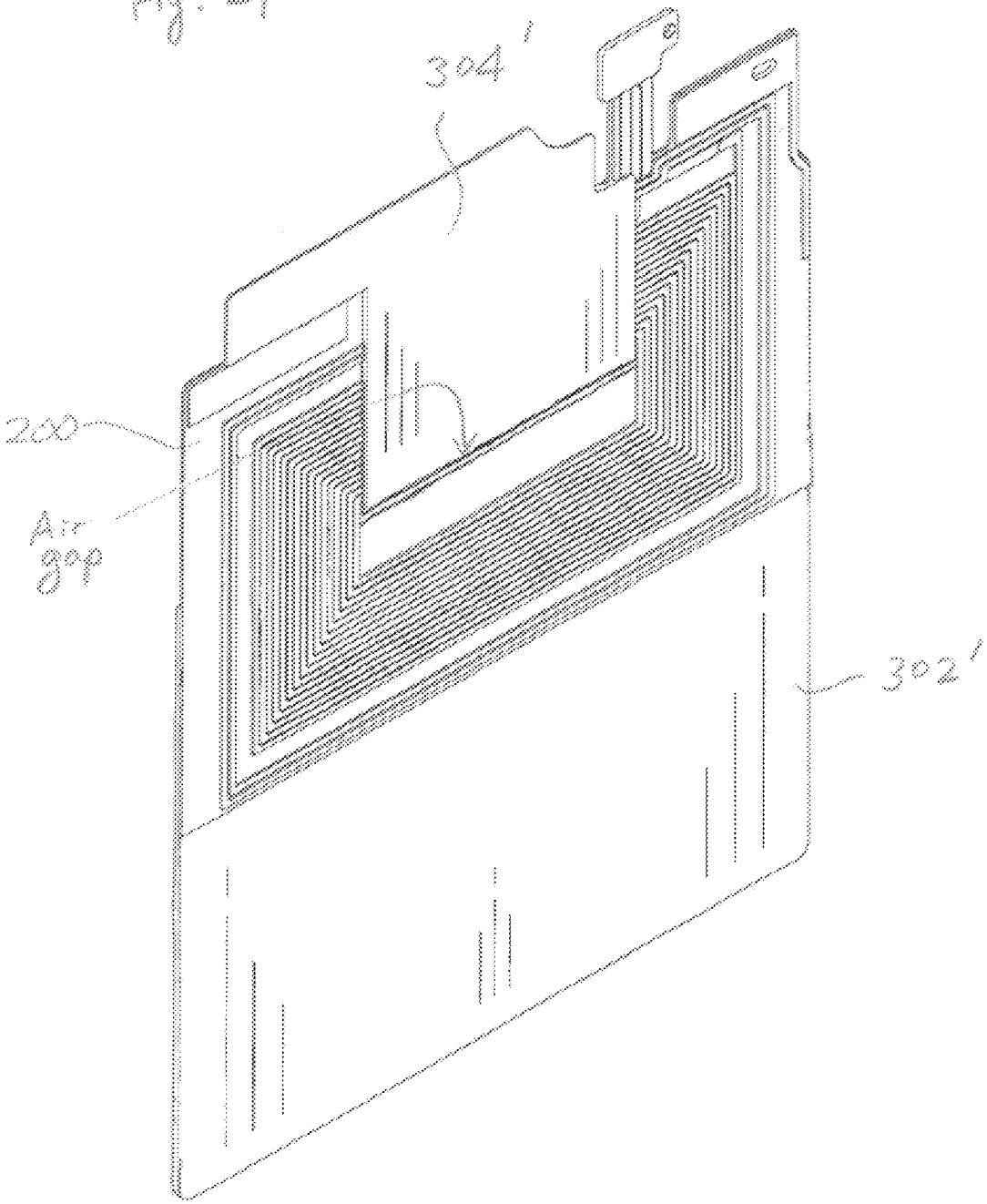
FIG. 24 is a perspective view of an assembly of a flexible PCB and multiple magnetic sheet pieces according to another embodiment of the invention.

In embodiments, instead of the magnetic sheet discussed in the above, two or more separate magnetic sheet pieces can be used. In embodiments, referring to FIG. 24, the two or more magnetic sheet pieces include a first magnetic sheet piece 304' and a second magnetic sheet piece 302'. In one embodiment, the first magnetic sheet piece 304' can have substantially the same size and shape with the head portion 304 of the magnetic sheet 300 shown in the drawings. Further, the second magnetic sheet piece 302' can have substantially the same the same size and shape with the head portion 304 of the magnetic sheet 300 shown in the drawings. As shown in FIG. 24, the first magnetic sheet piece 304' and the second magnetic sheet piece 302' are slightly spaced from each other and have an air gap therebetween. The size of air gap (distance between two opposing edges of the first and second magnetic sheet pieces) can be at or about 0.05 mm, 0.1 mm, 0.15 mm, 0.2 mm, 0.25 mm, 0.3 mm, 0.35 mm, 0.4 mm, 0.45 mm, 0.5 mm, 0.6 mm, 0.7 mm, 0.8 mm, 0.9 mm, 1 mm, 2 mm, 3 mm or 4 mm. In embodiments, the size of air gap may be within a range formed by selecting any two numbers listed in the immediately previous sentence, e.g., between about 0.05 mm and about 0.5 mm or between about 0.3 mm and about 1 mm. However, the invention is not limited thereto, the first magnetic sheet piece 304' and the second magnetic sheet piece 302' can overlap each other in the through hole of the flexible PCB.

Single Body of Flexible Antenna Module

Over surfaces of the assembly of the flexible PCB and the magnetic sheet, in embodiments, protective and insulation coatings are further coated to complete making the single body of the flexible antenna module.

Flexible Antenna Module in Smartphone

Figures 10, 11, 12, 13, 14:
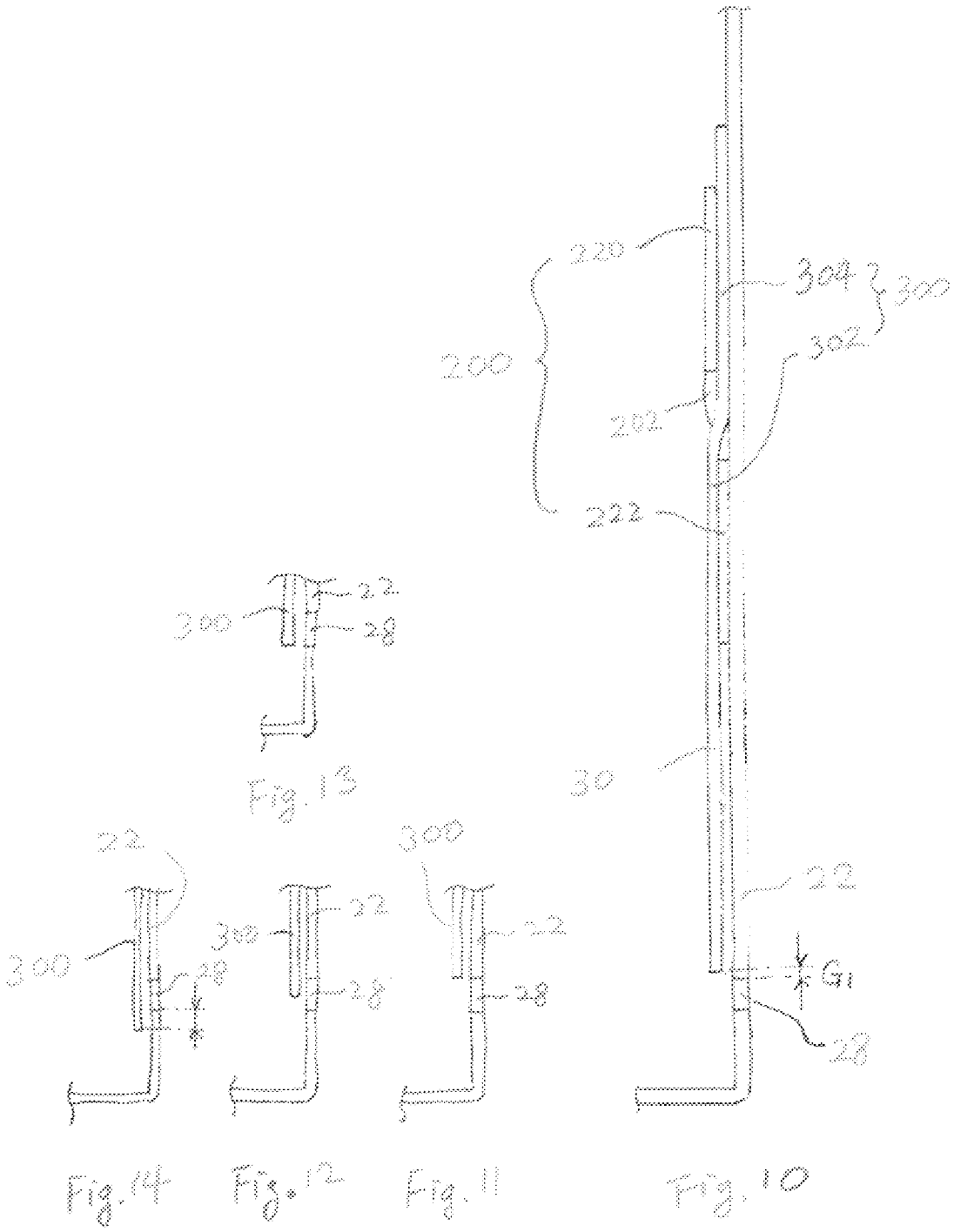
FIG. 10 is a partial sectional view of a rear cover of a smartphone and an antenna module according to an embodiment of the invention, showing locational relationship between the rear cover and the antenna module.
FIGS. 11-14 are partial sectional views showing locational relationship between the rear cover and the antenna module according to various embodiments of the invention.
Figure 15:
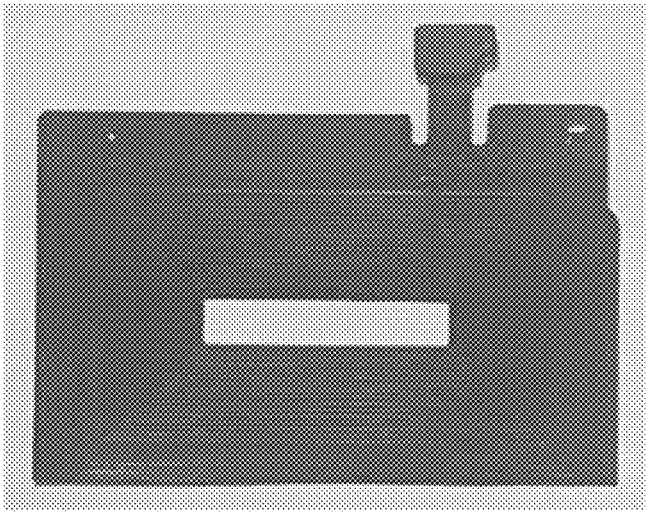
FIG. 15 is a photo showing a front view of a flexible PCB according to an embodiment of the invention, respectively.
Figure 16:
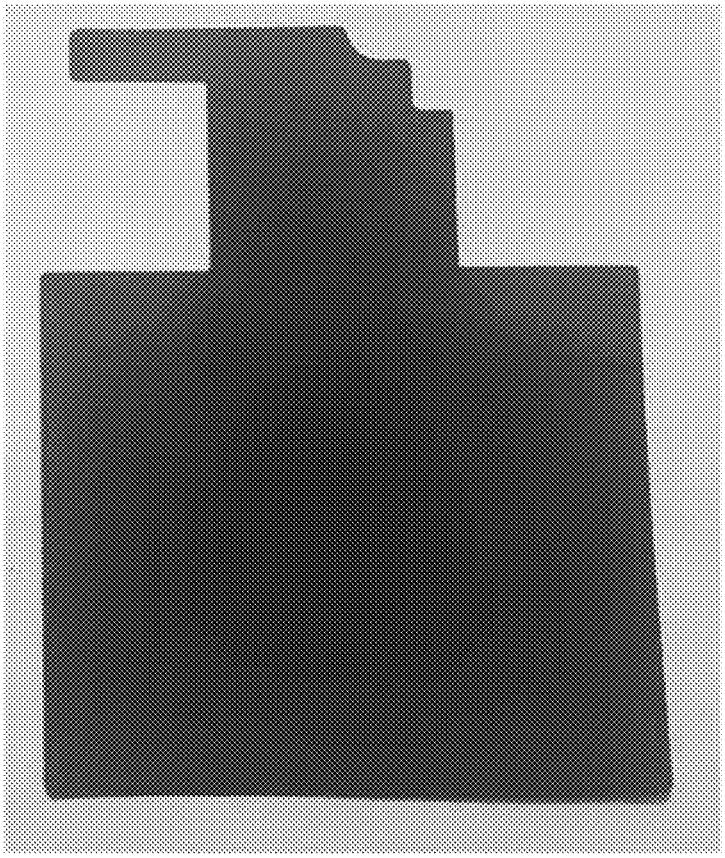
FIG. 16 is a photo showing a front view of a magnetic sheet according to an embodiment of the invention.
Figure 17:
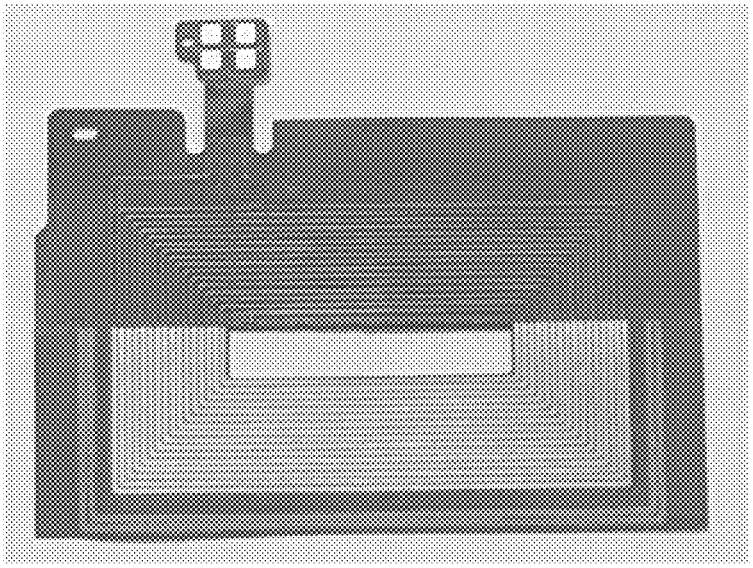
FIG. 17 is a photo showing a rear view of the flexible PCB shown in FIG. 15.
Figure 18:
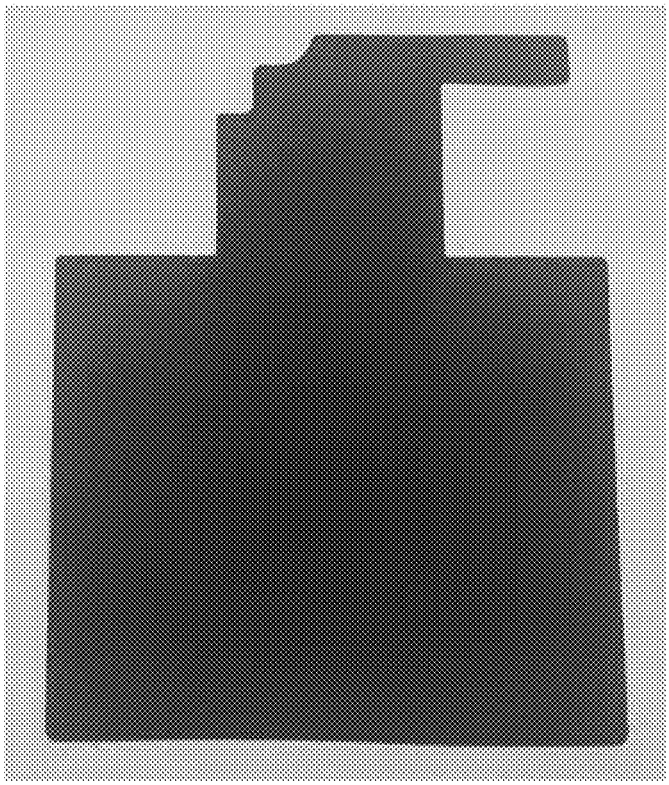
FIG. 18 is a photo showing a rear view of the magnetic sheet shown in FIG. 16.
Figure 19:
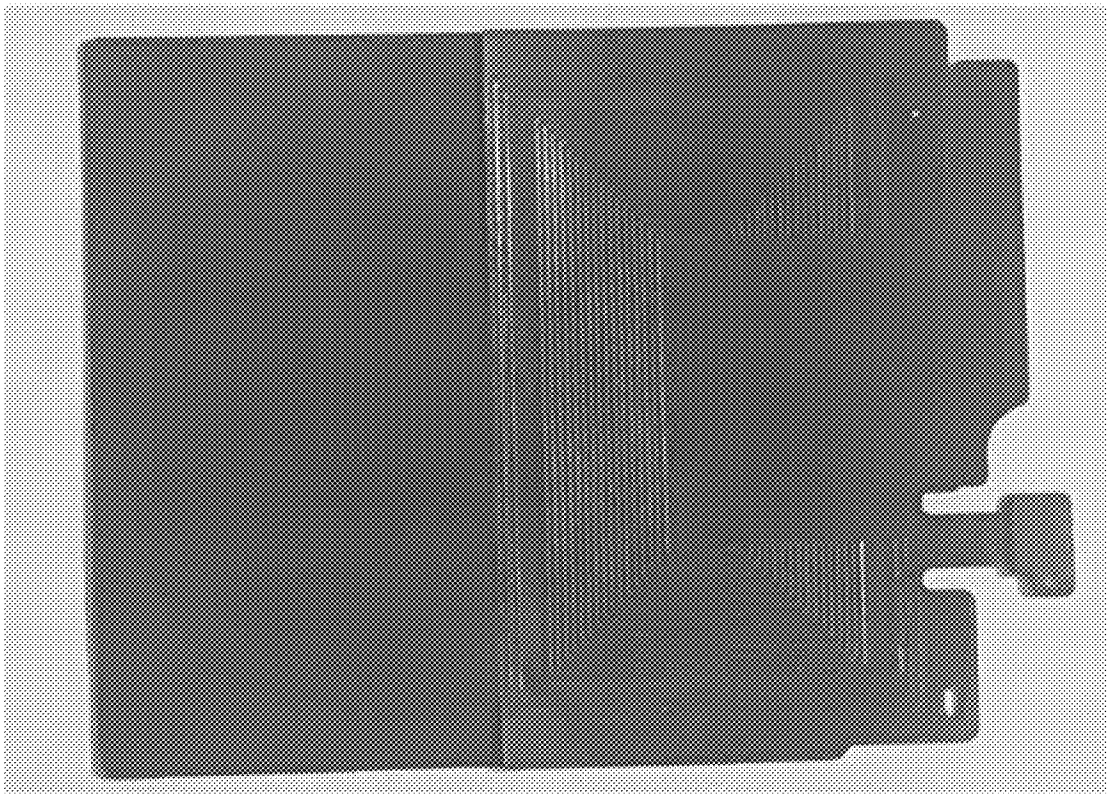
FIG. 19 is a photo showing a front view of an assembly of the flexible PCB shown in FIG. 15 and the magnetic sheet shown in FIG. 16.
Figure 20:
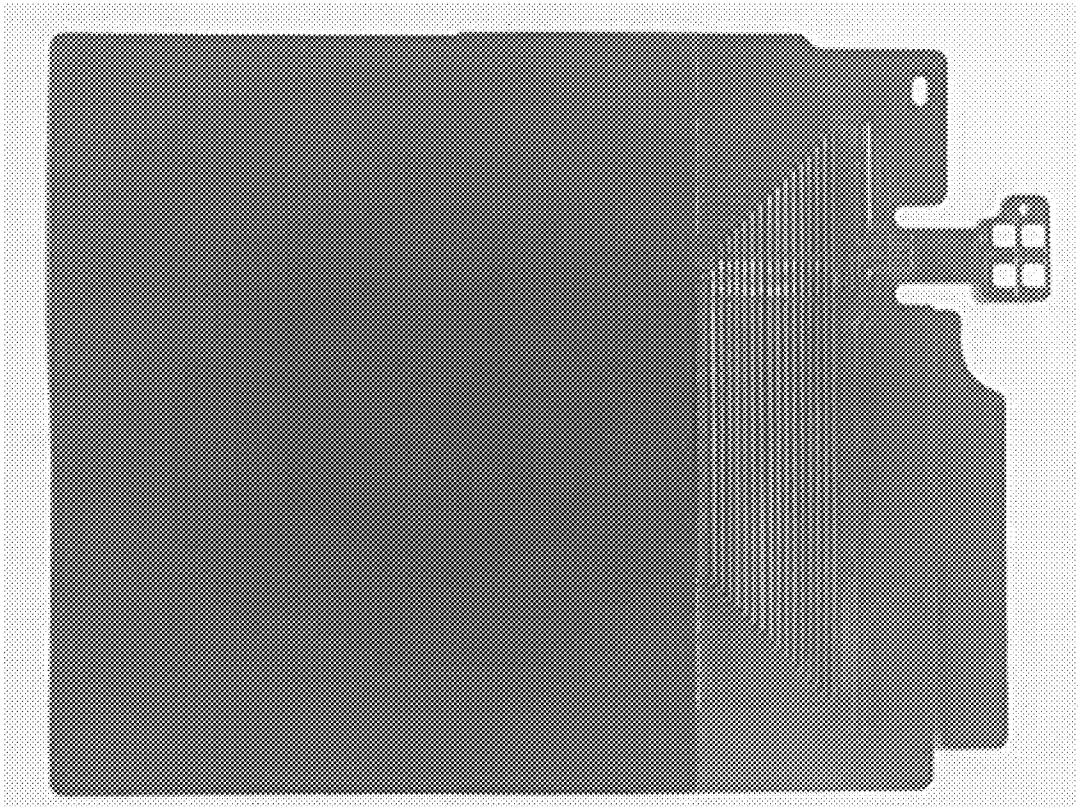
FIG. 20 is a photo showing a rear view of the assembly shown in FIG. 19.

In embodiments, referring to FIGS. 2 and 10, the flexible antenna module 100 is attached to the smartphone's rear cover 22. The connector pads 212 of the connector portion 208 are electrically connected to circuits in the smartphone 10.

First Coil Antenna for MST Antenna

In embodiments, the inner and outer terminals of the first coil antenna may be connected to an MST circuit in the smartphone 10 such that the first coil antenna functions as an MST antenna. Magnetic secure transmission (MST) is also referred as magnetic stripe transmission or magnetic secure transmission as disclosed in US 2016/0180120 A1 entitled "MAGNETIC SECURE TRANSMISSION DEVICE HARDWARE," the entire disclosure of which is incorporated by reference herein. In other embodiments, however, the second coil antenna may function as an MST antenna.

Second Coil Antenna for NFC Antenna

In embodiments, the inner and outer terminals of the second coil antenna 206 are connected to an NFC circuit in the smartphone 10 such that the second coil antenna functions as an NFC antenna. Near Field Communication (NFC) is a standard allowing wireless communication in a Radio Frequency (RF) band between portable devices, such as smartphones, or between a portable device and a fixed device (an NFC terminal). In other embodiments, however, the first coil antenna may function as an NFC antenna.

Operation of First and Second Coils

In embodiments, the smartphone with the antenna module has a controller which operates the first and second coils as an MST antenna and an NFC antenna, respectively. The controller can operate the antenna coils such that the first coil antenna does not operate as an MST antenna while the second coil is operating as an NFC antenna. Similarly, the controller operates the antenna coils such that the second coil antenna does not operate as an NFC antenna while the first coil is operating as an MST antenna. In some embodiments, the antenna module may have three or more coil antennas and the controller operates the three or more coil antennas such that only one coil antenna among the three or more coil antennas is operating and the other coil antennas is not working. In embodiments, the controller does not operate two or more coil antennas among the three or more coil antennas at the same time.

Smartphone's Rear Cover and Antenna Module

In embodiments, referring to FIGS. 2 and 10, the antenna module 100 is attached to the smartphone's rear cover 22 such that the head portion 304 is interposed between the first PCB portion 220 and the rear cover or rear wall 22 while the second PCB portion 222 is interposed between the base portion 302 and the rear cover 22. However, the invention is not limited thereto. In other embodiments, the base portion is interposed between the second PCB portion and the rear cover while the first PCB portion is interposed between the head portion and the rear cover.

Material 7 of Rear Cover

In embodiments, referring to FIGS. 2 and 10, the smartphone 10 includes a rear cover 22. The rear cover can be made of non-metal material, for example, a plastic resin. Generally, non-metal rear covers do not interfere with wireless communications between antennas inside the smartphone and devices outside the smartphone. In other embodiments, the rear cover can be made of a metal which is electrically conductive and non-magnetic. For example, copper or aluminum may be used for the rear cover. Generally, metal rear covers can interfere with wireless communications between antennas inside the smartphone and devices outside the smartphone.

Metal Rear Cover of Smartphone

In embodiments, referring to FIGS. 2 and 10, when the rear cover 22 is made of a metallic material, a smartphone 10 has a non-metal strip portion 28 in the rear cover and the antenna module is located with respect to the non-metal strip portion 28 to reduce or minimized interference caused by the metallic rear cover.

Locational Relationship Between Magnetic Sheet and Non-Metal Portion of Rear Cover In embodiments, referring to FIG. 10, the magnetic sheet 300 has a lower end and the antenna module is located in the smartphone such that the lower end of the magnetic sheet 300 is sufficiently close to the non-magnetic strip portion 28. This configuration allows the electromagnetic signals generated from the first coil antenna 204 or the second coil antenna 206 to be transmitted through the non-magnetic strip portion 28. In other embodiments, as shown in FIGS. 11-14, the antenna module is attached to the rear cover such that the magnetic sheet 300 partially or completely overlaps or covers the non-magnetic strip portion 28.

One or More Additional Coil Antennas in Antenna Module

In embodiments, the antenna module may further include one or more additional antennas which include a third coil antenna surrounding the second coil antenna. The magnetic sheet overlaps coil portions of the third coil antenna that are located in each of the first PCB portion and the second PCB portion. In other embodiments, the magnetic sheet does not overlap coil portions of the third coil antenna that are located in of the first PCB portion while the magnetic sheet overlaps coil portions of the third coil antenna that are located in the second PCB portion. In one embodiment, when the antenna module is assembled in a smartphone, the first coil antenna functions as an MST antenna, the second coil antenna functions as an NFC antenna and the third coil antenna functions as a wireless charging transformer. However, the invention is not limited thereto. In another embodiment, when the antenna module is assembled in a smartphone, the second coil antenna functions as an MST antenna, the third coil antenna functions as an NFC antenna and the first coil antenna functions as a wireless charging transformer. Still in another embodiment, when the antenna module is assembled in a smartphone, the third coil antenna functions as an MST antenna, the first coil antenna functions as an NFC antenna and the second coil antenna functions as a wireless charging transformer. In other embodiments, one of the coil antenna can functions both the MST antenna and the NFC antenna according to control signals from the controller in the smartphone. In the foregoing embodiments, for the third coil antenna, the PCB connector portion further includes additional pads and additional connector lines are provided such that there is no electric connection between one of the first, second and third coil antennas and the other coil antennas.

Separate Coil Antenna Outside Flexible PCB

In embodiments, the antenna module may include one or more coil antennas that are not part of the flexible PCB. The one or more coil antennas comprise a fourth coil antenna that are not part of the flexible PCB and placed over the magnetic sheet. In one embodiment, the entire portion of the fourth coil antenna may be placed over the magnetic sheet and may be interposed between the magnetic sheet and the rear wall or rear cover of the smartphone when the antenna module is assembled in the smartphone. In the other embodiment, the fourth coil antenna is placed over both flexible PCB and the magnetic coil. Further, in one embodiment, the fourth coil antenna may be a winding antenna shown in FIG. 21. The fourth coil antenna may be disposed in a side-by-side relationship with the antenna coils in the flexible PCB, and the flexible PCB may further include a bridge portion as shown in FIGS. 21-23 for providing an electrical connection of the inner terminal of the fourth coil antenna to the PCB connector portion.

Other Embodiments

Figure 21:
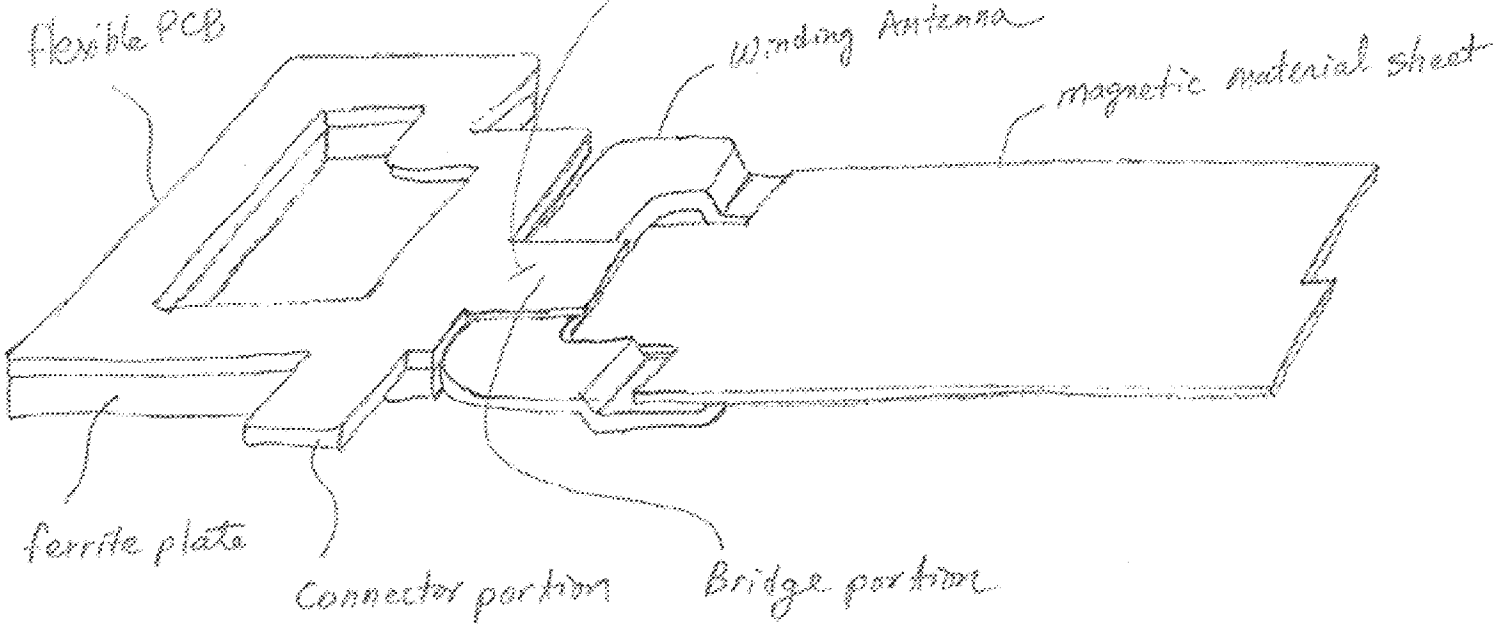
FIG. 21 is a perspective view of a smartphone antenna module and shows another embodiment of the invention.
Figure 22:
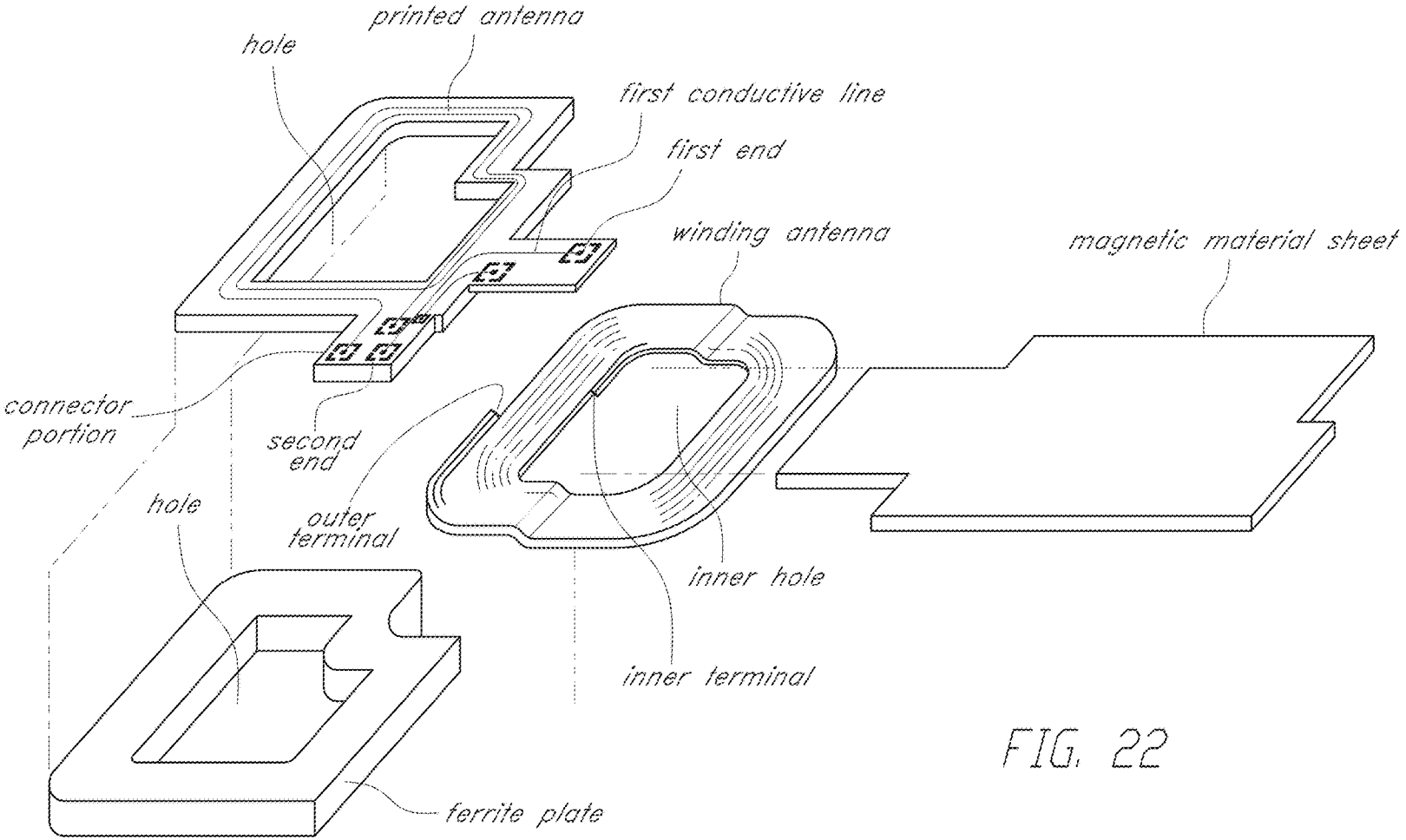
FIG. 22 is an exploded view of the smartphone antenna module shown in FIG. 21.
Figure 23:
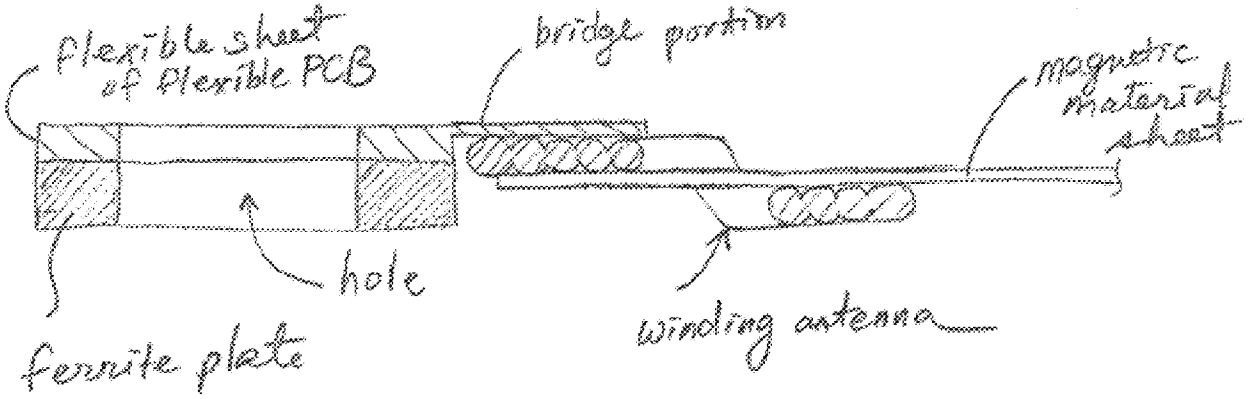
FIG. 23 is a sectional view of the smartphone antenna module shown in FIG. 21.

Embodiments shown in FIGS. 21-23 provides following features. One embodiment provides a smartphone antenna module for use in a smartphone comprising:

- a winding antenna comprising a winding of at least one wire with an inner terminal and an outer terminal, the inner terminal being located in an inner portion of the winding and the outer terminal being located in an outer portion of the winding;
- a flexible PCB (printed circuit board) comprising a thin flexible body comprising a printed antenna portion, a bridge portion and a connector portion;

the printed antenna portion comprising a printed antenna in the flexible PCB;

a first conductive line formed in the flexible PCB and extending between a first end and a second end, the first end and at least part of the first conductive line formed in the bridge portion;

the connector portion accommodating at least part of the connection terminals for the printed antenna and the winding antenna for connecting to a counterpart connection terminal of a smartphone; and the bridge portion extending across the winding such that the bridge portion and a portion of the winding overlap when viewed in a viewing direction perpendicular to a major surface of the bridge portion and further such that the first end of the conductive line reaches the inner portion of the winding for electrical connection with the inner terminal of the winding antenna, the major surface being the most wide surface of the bridge portion, wherein a thickness of the bridge portion in the viewing direction including the first conductive line integrated therein is smaller than a thickness of the at least one wire in the viewing direction.

In the smartphone antenna module of proceeding embodiment, the printed antenna portion including the printed antenna is at least in part thicker than the bridge portion including the first conductive line. In the smartphone antenna module of proceeding embodiments, the thickness of the bridge portion at any point thereof is smaller than a thickness of the printed antenna portion in the viewing direction. In the smartphone antenna module of any one of the preceding embodiments, the printed antenna and the winding antenna are arranged generally side by side such that the printed antenna and the winding antenna do not overlap when viewed in the viewing direction. In the smartphone antenna module of any one of the preceding embodiments, the antenna module further comprises a second conductive line extending in the bridge portion and comprising a third end and a fourth end, wherein the third end is connected to the outer portion of the winding for electrical connection with the outer terminal of the winding antenna. In the antenna module shown in FIGS. 21-23, there is no electric connection between the winding antenna and the coil antenna in the flexible PCB.

In the smartphone antenna module of any one of the preceding embodiments, each of the first and second conductive lines has a thickness substantially smaller than its width (e.g., width at least 3 times thickness). In the smartphone antenna module of any one of the preceding embodiments, one of the first and second conductive lines has a thickness substantially smaller than its width. In the smartphone antenna module of any one of the preceding embodiments, the flexible PCB and the winding antenna are arranged generally side by side such that the printed antenna portion and the winding antenna do not overlap when viewed in the viewing direction.

In the smartphone antenna module of any one of the preceding embodiments, the printed antenna and the winding antenna are electrically decoupled within the smartphone antenna module. In the smartphone antenna module of any one of the preceding embodiments, the second end is formed in the connector portion. In the smartphone antenna module of any one of the preceding embodiments, the antenna module further comprises a second conductive line formed in the flexible PCB extending between a third end and a fourth end. In the smartphone antenna module of any one of the preceding embodiments, the third end is formed in the bridge portion, and the fourth end is formed in the connector portion.

In the smartphone antenna module of any one of the preceding embodiments, the connector portion is referred to as a first connector portion, the antenna module further comprises a second connector portion, wherein the third end is formed in the second connector portion, and the fourth end is formed in the first connector portion. In the smartphone antenna module of any one of the preceding embodiments, the connector portion is referred to as a first connector portion, wherein the antenna module further comprises a second connector portion and a third connector portion, wherein the third end is formed in the second connector portion, and the fourth end is formed in the third connector portion. In the smartphone antenna module of any one of the preceding embodiments, each of the first, second, third and fourth ends comprises a contact pad.

In the smartphone antenna module of any one of the preceding embodiments, the contact pads of the first and third ends face in a first direction wherein the contact pads of the second and fourth ends face in a second direction opposite to the first direction. In the smartphone antenna module of any one of the preceding embodiments, the contact pads of the first, second, third and fourth ends face in the same direction. In the smartphone antenna module of any one of the preceding embodiments, the connection terminals for the winding antenna comprise the second end of the first conductive line and the fourth end of the second conductive line.

In the smartphone antenna module of any one of the preceding embodiments, the printed antenna comprises a coil of a printed wire. In the smartphone antenna module of any one of the preceding embodiments, each of the first and second ends comprises a contact pad. In the smartphone antenna module of any one of the preceding embodiments, the connection terminals for the printed antenna comprise first and second connection terminals connected to first and second ends of the printed wire, respectively, wherein each of the first and second connection terminals comprises a contact pad, wherein the contact pads of the first and second connection terminals and the contact pads of the first end of the first conductive line face the same direction.

In the smartphone antenna module of any one of the preceding embodiments, the printed antenna comprises a coil of a printed wire, wherein the flexible PCB comprises a hole surrounded by the coil of the printed wire. In the smartphone antenna module of any one of the preceding embodiments, the coil of the printed wire comprises 2-7 turns, in one embodiment, 3-5 turns. In the smartphone antenna module of any one of the preceding embodiments, a thickness of the printed antenna portion including the printed antenna is about 100-140 μm, in one embodiment, about 120 μm, wherein a thickness of the bridge portion including the first conductive line is about 40-80 μm, in one embodiment, about 60 μm. In the smartphone antenna module of any one of the preceding embodiments, the module further comprises a magnetic material plate attached to the flexible PCB. In the smartphone antenna module of any one of the preceding embodiments, the magnetic material plate comprises a ferrite plate which comprises a hole aligned with the hole of the flexible PCB.

In the smartphone antenna module of any one of the preceding embodiments, the winding antenna comprises a coil of an insulation-coated wire. In the smartphone antenna module of any one of the preceding embodiments, the at least one wire comprises an enamel-coated wire, wherein the winding has a single layer of the enamel-coated wire such that the layer of the coil of the coated wire has a thickness substantially same as the diameter of coated wire. In the smartphone antenna module of any one of the preceding embodiments, the enamel-coated wire has a thickness about 100-140, in one embodiment, 120 μm. In the smartphone antenna module of any one of the preceding embodiments, the at least one wire comprise two or more wires, each of which comprises the inner terminal and the outer terminal, wherein the inner terminals of the two or more wires are attached to the contact pad of the first end of the first conductive line and the outer terminals of the two or more wires are attached to the contact pad of the third end of the second conductive line such that the two or more wires are electrically connected to each other in parallel. In the smartphone antenna module of any one of the preceding embodiments, the inner end of the wire is welded to the contact pad of the first end of the first conductive line. In the smartphone antenna module of any one of the preceding embodiments, the outer end of the wire is welded to the contact pad of the third end of the second conductive line. In the smartphone antenna module of any one of the preceding embodiments, each of the two or more wires has about 16-20 turns, in one embodiment, about 18 turns.

In the smartphone antenna module of any one of the preceding embodiments, the number of two or more wires is 2 as shown in FIG. 22, wherein the inner ends of the two wires are attached to the contact pad of the first conductive line, wherein the outer ends of the two wires are attached to the contact pad of the second conductive line, wherein the two wires are connected to each other in parallel. In the smartphone antenna module of any one of the preceding embodiments, the number of two or more wires is 3 or 4.

In the smartphone antenna module of any one of the preceding embodiments, the winding antenna does not comprise a portion of the wire which crosses the winding when viewed in the direction. In the smartphone antenna module of any one of the preceding embodiments, the winding antenna comprises an inner hole, wherein the smartphone antenna module comprises a magnetic material sheet extending through the inner hole.

In the smartphone antenna module of any one of the preceding embodiments, the magnetic material sheet comprises a neck extending through the inner hole and surrounded by the winding and a body connected to the neck and extending from the neck and away from the flexible PCB. In the smartphone antenna module of any one of the preceding embodiments, the magnetic material sheet is flat and the winding antenna is stepped for allowing the magnetic material sheet to extend through the inner hole without substantial deformation of the magnetic material sheet. In the smartphone antenna module of the foregoing embodiment, the printed antenna is for near field communication (NFC), wherein the winding antenna is for magnetic secure transmission (MST). In the smartphone antenna module of any one of the preceding embodiments, the printed antenna is configured to emit signals having about 13.56 MHz, and the winding antenna is configured to emit signals having about 85-100 KHz.

Other embodiments provide a smartphone comprising:

a display disposed at the front side of the smartphone;

a housing comprising a rear cover with a camera hole;

the smartphone antenna module housed in the housing;

a camera module comprising a lens aligned with the camera hole;

the smartphone antenna module of any one of the preceding embodiments; and a smartphone circuit module housed in the housing and comprising a connector portion which comprises terminals for electrically connecting with at least one terminal of the smartphone antenna module, wherein the smartphone antenna module is arranged within the housing such that the printed antenna portion of the smartphone antenna module surrounds the camera module when viewing in a direction perpendicular to the rear cover.

In the smartphone of proceeding embodiment, the rear cover comprises a metal plate and a plastic plate arranged in order along a longitudinal direction of the rear cover, wherein the metal plate is substantially longer than the plastic portion in the longitudinal direction, wherein the metal plate overlaps the flexible PCB and the winding antenna when viewed in the viewing direction. In the smartphone of any one of the preceding embodiments, the smartphone further comprises a magnetic material sheet comprising a main body and an insertion portion, wherein the magnetic material sheet is arranged with the smartphone antenna module such that the insertion portion is inserted into a central opening of the winding antenna and the main body extends in a direction away from the flexible PCB, wherein the metal plate overlaps the flexible PCB, winding antenna and the magnetic material sheet.

In the smartphone of any one of the preceding embodiments, the metal plate comprises an edge contacting, overlapping op neighboring the plastic plate, wherein the main body of the magnetic material sheet extends to or near the edge of the metal plate. In the smartphone of any one of the preceding embodiments, the metal plate comprises an edge contacting, overlapping op neighboring the plastic plate, wherein the main body of the magnetic material sheet extends to the plastic plate. In the smartphone of any one of the preceding embodiments, the metal plate extends at least three quarter the length of the rear cover in the longitudinal direction of the smartphone.

In the smartphone of any one of the preceding embodiments, the flexible PCB is disposed between the metal plate and the ferrite plate. In the smartphone of any one of the preceding embodiments, the magnetic material sheet is substantially parallel to the rear surface of the rear cover. In the smartphone of any one of the preceding embodiments, the metal portion comprises a non-magnetic metal which is electrically conductive. In the smartphone of any one of the preceding embodiments, the metal portion is made of aluminum.

In the smartphone of any one of the preceding embodiments, the smartphone further comprises a plastic sheet disposed between the smartphone antenna module and the rear cover. In the smartphone of any one of the preceding embodiments, the smartphone further comprise another plastic sheet disposed between the smartphone antenna module and the smartphone circuit.

In embodiments, referring to FIGS. 21-23, when the winding antenna is assembled in a smartphone, the winding antenna can be used for wirelessly charging a battery in the smartphone. The smartphone has a controller to control a charging circuit in the smartphone to operate the winding antenna as a transformer coil for wirelessly charging a battery when the smartphone is placed close to a wireless charger. In one embodiment, the entire portion of the magnetic sheet may be placed under the winding antenna coil.

Although embodiments of the invention have been described above, those skilled in the art may understand that configurations of the various embodiments described above may be changed without departing from the spirit of the invention. It will be also understood that the changes fall within the scope of the invention.

What is claimed is:

1. A smartphone antenna module:

a magnetic sheet comprising a first magnetic sheet portion, a second magnetic sheet portion and a third magnetic sheet portion interposed between the first and second magnetic sheet portions, a flexible PCB in form of a sheet having a thickness, the flexible PCB comprising a first coil antenna and a second coil antenna; and a through hole formed through the thickness of the sheet of the flexible PCB such that the flexible PCB comprises a first PCB section and a second PCB section located on an opposite side of the first PCB section across the through hole, wherein, when viewed in a thickness direction of the flexible PCB, the first coil antenna comprises two or more coiled turns turning around the through hole, and the second coil antenna comprises two or more coiled turns turning around the first coil antenna and the through hole, wherein no electrical connection is formed between the first coil antenna and the second coil antenna within the flexible PCB, wherein the flexible PCB and the magnetic sheet are integrated in a single, flexible body, in which the flexible PCB and the magnetic sheet are arranged relative to each other such that:

at least part of the third magnetic sheet portion passes the through hole, the first magnetic sheet portion is placed over the first PCB section and overlaps, when viewed in the thickness direction, a first coil portion of the first coil antenna formed in the first PCB section of the flexible PCB while not overlapping, when viewed in the thickness direction, a second coil portion of the first coil antenna formed in the second PCB section that is placed across the through hole, the second magnetic sheet portion is placed under the second PCB section and overlaps, when viewed in the thickness direction, the second coil portion of the first coil antenna formed in the second PCB section of the flexible PCB while not overlapping, when viewed in the thickness direction, the first coil portion of the first coil antenna formed in the first PCB section placed across the through hole, and the second magnetic sheet portion further overlaps, when viewed in the thickness direction, a second coil portion of the second coil antenna formed in the second PCB section while not overlapping, when viewed in the thickness direction, a first coil portion of the second coil antenna formed in the first PCB section that is placed across the through hole.

2. The smartphone antenna module of claim 1, wherein the first magnetic sheet portion further overlaps the first coil portion of the second coil antenna that are formed in the first PCB section.

3. The smartphone antenna module of claim 2, wherein the first magnetic sheet portion extends in a direction away from the second magnetic sheet portion beyond the first coil portion of the second coil antenna.

4. The smartphone antenna module of claim 1, wherein the first magnetic sheet portion extends in a direction away from the second magnetic sheet portion beyond an edge of the flexible PCB.

5. The smartphone antenna module of claim 1, wherein the first coil antenna comprises a third portion that does not overlap the magnetic sheet at all.

6. The smartphone antenna module of claim 5, wherein the first coil antenna comprises a fourth portion that does not overlap the magnetic sheet at all, wherein the first, third, second and fourth portions of the first coil antenna are arranged in order surrounding the through hole.

7. The smartphone antenna module of claim 1, wherein the second coil antenna comprises a third portion and fourth portion that do not overlap the magnetic sheet at all, wherein the first, third, second and fourth portions of the second coil antenna are arranged in order surrounding the through hole.

8. The smartphone antenna module of claim 1, wherein the first magnetic sheet portion further overlaps the first coil portion of the second coil antenna that are formed in the first PCB section.

9. The smartphone antenna module of claim 1, wherein the first magnetic sheet portion has a first width for passing through the through hole without bending thereof whereas the second magnetic sheet portion has a second width for not passing through the through hole without bending thereof.

10. The smartphone antenna module of claim 1, wherein the through hole has a maximum linear length of an opening thereof, wherein the first magnetic sheet portion has a first width smaller than the maximum linear length whereas the second magnetic sheet portion has a second width larger than the maximum linear length.

11. The smartphone antenna module of claim 1, wherein the through hole has a maximum linear length of an opening thereof, wherein the first magnetic sheet portion has a first width larger than the maximum linear length whereas the second magnetic sheet portion has a second width larger than the maximum linear length.

12. The smartphone antenna module of claim 1, wherein the through hole has a maximum linear length of an opening thereof, wherein the first magnetic sheet portion has a first width smaller than the maximum linear length whereas the second magnetic sheet portion has a second width smaller than the maximum linear length.

13. The smartphone antenna module of claim 1, wherein the first coil antenna comprises a first inner terminal and a first outer terminal, wherein the flexible PCB further comprises a PCB connector for electrically connecting the first coil antenna to a first counterpart connector of a smartphone, wherein the PCB connector is electrically connected to the first inner terminal and the first outer terminal.

14. The smartphone antenna module of claim 13, wherein the flexible PCB further comprises a connection line interconnecting the first inner terminal and the PCB connector, wherein the connection line crosses over the first coil antenna and the second coil antenna.

15. The smartphone antenna module of claim 13, wherein the second coil antenna comprises a second inner terminal and a second outer terminal, wherein the PCB connector is also for electrically connecting the second coil antenna to a second counterpart connector of the smartphone, wherein the PCB connector is also electrically connected to the second inner terminal and the second outer terminal.

16. A smartphone comprising:

a display module comprising a display surface;

the smartphone antenna module of claim 1; and a rear wall facing away from the display surface and made of a non-magnetic material, wherein the magnetic sheet is arranged generally parallel to the rear wall.

17. The smartphone of claim 16, wherein at least part of the first magnetic sheet portion is interposed between the rear wall and the first PCB section whereas at least part of the second PCB section is interposed between the rear wall and the second magnetic sheet portion.

18. The smartphone of claim 16, wherein the first coil antenna is connected to a first smartphone circuit for magnetic secure transmission (MST) using a frequency range of 85-100 KHz, wherein the second coil antenna is connected to a second smartphone circuit for near field communication (NFC) using 13.56 MHz.

19. A smartphone antenna module:

a magnetic sheet comprising a first magnetic sheet portion, a second magnetic sheet portion and a third magnetic sheet portion interposed between the first and second magnetic sheet portions, a flexible PCB in form of a sheet having a thickness, the flexible PCB comprising a first coil antenna, a second coil antenna and a third coil antenna; and a through hole formed through the thickness of the sheet of the flexible PCB such that the flexible PCB comprises a first PCB section, and a second PCB section located on an opposite side of the first PCB section across the through hole, wherein, when viewed in a thickness direction of the flexible PCB, the first coil antenna comprises two or more coiled turns turning around the through hole, and the second coil antenna comprises two or more coiled turns turning around the first coil antenna, the third coil antenna and the through hole, wherein no electrical connection is formed between the first coil antenna and the second coil antenna within the flexible PCB, no electrical connection is formed between the third coil and the first coil antenna within the flexible PCB, and no electrical connection is formed between the third coil and the second coil antenna within the flexible PCB, wherein the flexible PCB and the magnetic sheet are integrated in a single, flexible body, in which the flexible PCB and the magnetic sheet are arranged relative to each other such that:

at least part of the third magnetic sheet portion passes the through hole, the first magnetic sheet portion is placed over the first PCB section and overlaps, when viewed in the thickness direction, a first coil portion of the first coil antenna formed in the first PCB section of the flexible PCB while not overlapping, when viewed in the thickness direction, a second coil portion of the first coil antenna formed in the second PCB section that is placed across the through hole, the second magnetic sheet portion is placed under the second PCB section and overlaps, when viewed in the thickness direction, the second coil portion of the first coil antenna formed in the second PCB section of the flexible PCB while not overlapping, when viewed in the thickness direction, the first coil portion of the first coil antenna formed in the first PCB section that is placed across the through hole, and the second magnetic sheet portion further overlaps, when viewed in the thickness direction, a second coil portion of the second coil antenna formed in the second PCB section while not overlapping, when viewed in the thickness direction, a first coil portion of the second coil antenna formed in the first PCB section that is placed across the through hole.

20. The smartphone antenna module of claim 19, wherein, when viewed in a thickness direction of the flexible PCB, the third coil antenna comprises more than one coiled turns encircling around the first coil antenna and the through hole.

21. A smartphone comprising:

a display module comprising a display surface;

the smartphone antenna module of claim 19; and a rear wall facing away from the display surface and made of a non-magnetic material, wherein the magnetic sheet is arranged generally parallel to the rear wall.

22. The smartphone of claim 21, wherein the first coil antenna is connected to a first smartphone circuit and configured for magnetic secure transmission (MST) using a frequency range of 85-100 KHz, wherein the second coil antenna is connected to a second smartphone circuit and configured for near field communication (NFC) using 13.56 MHz, wherein the third coil antenna is connected to a third smartphone circuit and configured for wireless charging the smartphone.

* * * * *